US006530511B2

(12) United States Patent
Garcia et al.

(10) Patent No.: US 6,530,511 B2
(45) Date of Patent: Mar. 11, 2003

(54) WIRE FEED MECHANISM AND METHOD USED FOR FABRICATING ELECTRICAL CONNECTORS

(75) Inventors: Steven E. Garcia, Colorado Springs, CO (US); Randall J. Boudreaux, Colorado Springs, CO (US)

(73) Assignee: Medallion Technology, LLC, Houston, TX (US)

( * ) Notice: Subject to any disclaimer, the term of this patent is extended or adjusted under 35 U.S.C. 154(b) by 0 days.

(21) Appl. No.: 09/782,991

(22) Filed: Feb. 13, 2001

(65) Prior Publication Data

US 2002/0108985 A1 Aug. 15, 2002

(51) Int. Cl.[7] ..... B65H 20/30; H01R 43/04

(52) U.S. Cl. ..... 226/118.4; 226/45; 029/882

(58) Field of Search ..... 226/45, 115, 118.1, 226/118.4; 242/418.1; 29/882

(56) References Cited

U.S. PATENT DOCUMENTS

| | | | | |
|---|---|---|---|---|
| 2,064,545 A | * | 12/1936 | Kleinmann et al. | |
| 2,234,641 A | | 3/1941 | Baumgartner | |
| 2,752,580 A | * | 6/1956 | Shewmaker | |
| 2,838,455 A | * | 6/1958 | Kraay et al. | 156/910 |
| 3,017,605 A | * | 1/1962 | Platz et al. | |
| RE25,798 E | * | 6/1965 | Platz et al. | |
| 3,205,469 A | * | 9/1965 | Frank et al. | |
| 3,255,430 A | * | 6/1966 | Phillips | |
| 3,258,736 A | * | 6/1966 | Crawford et al. | |
| 3,277,560 A | * | 10/1966 | Frank et al. | |
| 3,319,217 A | * | 5/1967 | Phillips | |
| 3,333,225 A | * | 7/1967 | McNutt | |
| 3,400,358 A | * | 9/1968 | Byrnes et al. | |
| 3,402,466 A | * | 9/1968 | Phillips | |
| 3,612,369 A | * | 10/1971 | Grebe et al. | 226/115 |
| 3,817,067 A | * | 6/1974 | Voorehes et al. | 226/42 |
| 3,888,401 A | | 6/1975 | Minall et al. | |
| 3,890,865 A | | 6/1975 | Tarbox et al. | |
| 4,043,494 A | | 8/1977 | Bickford et al. | |
| 4,076,356 A | * | 2/1978 | Tamburro | |
| 4,119,206 A | * | 10/1978 | Woodman et al. | 198/346.2 |
| 4,358,180 A | | 11/1982 | Lincoln | |
| 4,422,583 A | * | 12/1983 | Maxner et al. | 226/115 |
| 4,505,529 A | * | 3/1985 | Barkus | |
| 4,584,912 A | | 4/1986 | Gudmestad et al. | |
| 4,690,349 A | * | 9/1987 | Yamaguchi et al. | 226/118.2 |
| 4,742,973 A | | 5/1988 | Stomski et al. | |

(List continued on next page.)

FOREIGN PATENT DOCUMENTS

| | | |
|---|---|---|
| JP | 55133549 | 10/1980 |
| JP | 55133550 | 10/1980 |
| JP | 568827 | 1/1981 |
| JP | 63208237 | 8/1988 |
| JP | 63293845 | 11/1988 |
| JP | 3209173 | 9/1991 |
| JP | 3209174 | 9/1991 |
| WO | WO 94/19518 | 9/1994 |

*Primary Examiner*—Michael R. Mansen
(74) *Attorney, Agent, or Firm*—John R. Ley

(57) ABSTRACT

Wire from a wire source is supplied to create a predetermined amount of slack wire in a predetermined configuration and to maintain that slack wire configuration. Some of the slack wire is withdrawn from the configuration and advanced for use in forming an electrical connector. As wire is withdrawn from the slack wire configuration, additional wire is supplied to renew and maintain that configuration. A characteristic of the slack wire configuration is sensed to control the amount wire supplied. In this manner, the mass and rotational effects of unwinding wire from a spool while simultaneously advancing that wire are avoided, thereby avoiding wire slippage and allowing the constituent components of the connector, such as bulges of a twist pin connector, to be more precisely located during fabrication.

68 Claims, 7 Drawing Sheets

U.S. PATENT DOCUMENTS 4,773,877 A * 9/1988 Krüger et al.
4,843,315 A * 6/1989 Bayer et al.
4,889,496 A * 12/1989 Neidich
4,911,645 A * 3/1990 August et al.
4,951,369 A 8/1990 Verrall
5,014,419 A 5/1991 Cray et al.
5,033,785 A 7/1991 Woolley, Jr.
5,050,295 A * 9/1991 Sullivan et al.
5,051,108 A * 9/1991 Lincoln
5,054,192 A 10/1991 Cray et al.
5,106,310 A * 4/1992 Krajewski et al.
5,112,232 A 5/1992 Cray et al.
5,129,830 A 7/1992 Krajewski et al.
RE34,084 E * 9/1992 Noschese
5,184,400 A * 2/1993 Cray et al. ..... 29/877
5,255,836 A 10/1993 Herber et al.
5,263,307 A 11/1993 Hasui
5,277,018 A 1/1994 Puiol-Isern
5,331,867 A 7/1994 Carpenter et al.
5,388,998 A 2/1995 Grange et al.
5,667,410 A 9/1997 Johnston
5,676,013 A 10/1997 Kahlau
5,865,051 A 2/1999 Otzen et al.
5,867,896 A 2/1999 Watanabe
5,904,059 A 5/1999 Perna
6,009,738 A 1/2000 Beecher et al.
6,043,666 A 3/2000 Kazama

* cited by examiner

WIRE FEED MECHANISM AND METHOD USED FOR FABRICATING ELECTRICAL CONNECTORS

CROSS-REFERENCE TO RELATED INVENTIONS

This invention is related to inventions for High-Speed, High-Capacity Twist Pin Connector Fabricating Machine and Method, Rotational Grip Twist Machine and Method for Fabricating Bulges of Twisted Wire Electrical Connectors, and Pneumatic Inductor and Method of Electrical Connector Delivery and Organization, described in the concurrently-filed U.S. patent applications Ser. Nos. 09/782,987; 09/782,888; and 09/780,981, respectively, all of which are assigned to the assignee hereof, and all of which have at least one common inventor with the present application. The disclosures of these concurrently filed applications are incorporated herein by this reference.

FIELD OF THE INVENTION

This invention generally relates to the fabrication of electrical interconnectors used to electrically connect printed circuit boards and other electrical components in a vertical or z-axis direction to form three-dimensional electronic modules. More particularly, the present invention relates to a new and improved machine and method for fabricating z-axis interconnectors of the type formed from helically coiled strands of wire, in which at least one longitudinal segment of the coiled strands is untwisted in an anti-helical direction to expand the strands of wire into a resilient bulge. Bulges of the interconnector are then inserted into vias of vertically stacked printed circuit boards to establish an electrical connection through the z-axis interconnector between the printed circuit boards of the three dimensional module.

BACKGROUND OF THE INVENTION

The evolution of computer and electronic systems has demanded ever-increasing levels of performance. In most regards, the increased performance has been achieved by electronic components of ever-decreasing physical size. The diminished size itself has been responsible for some level of increased performance because of the reduced lengths of the paths through which the signals must travel between separate components of the systems. Reduced length signal paths allow the electronic components to switch at higher frequencies and reduce the latency of the signal conduction through relatively longer paths. One technique of reducing the size of the electronic components is to condense or diminish the space between the electronic components. Diminished size also allows more components to be included in a system, which is another technique of achieving increased performance because of the increased number of components.

One particularly effective approach to condensing the size between electronic components is to attach multiple semiconductor integrated circuits or "chips" on printed circuit boards, and then stack multiple printed circuit boards to form a three-dimensional configuration or module. Electrical interconnectors are then extended vertically, in the z-axis dimension, between the printed circuit boards which are oriented in the horizontal x-axis and y-axis dimensions. The z-axis interconnectors, in conjunction with conductor traces of each printed circuit board, connect the chips of the module with short signal paths for efficient functionality. The relatively high concentration of chips, which are connected by the three-dimensional, relatively short length signal paths, are capable of achieving very high levels of functionality.

The vertical electrical connections between the stacked printed circuit boards are established by using z-axis interconnectors. Z-axis interconnectors contact and extend through plated through holes or "vias" formed in each of the printed circuit boards. The chips of each printed circuit board are connected to the vias by conductor traces formed on or within each printed circuit board. The vias are formed in each individual printed circuit board of the three-dimensional modules at the same locations, so that when the printed circuit boards are stacked in the three-dimensional module, the vias of all of the printed circuit boards are aligned vertically in the z-axis. The z-axis interconnectors are then inserted vertically through the aligned vias to establish an electrical contact and connection between the vertically oriented vias of each module.

Because of differences between the individual chips on each printed circuit board and the necessity to electrically interconnect to the chips of each module in a three-dimensional sense, it is not always required that the z-axis interconnectors electrically connect to the vias of each printed circuit board. Instead, those vias on those circuit boards for which no electrical connection is desired are not connected to the traces of that printed circuit board. In other words, the via is formed but not connected to any of the components on that printed circuit board. When the z-axis interconnector is inserted through such a via, a mechanical connection is established, but no electrical connection to the other components of the printed circuit board is made. Alternatively, each of the z-axis interconnectors may have the capability of selectively contacting or not contacting each via through which the interconnector extends. Not contacting a via results in no electrical connection at that via. Of course, no mechanical connection exists at that via either, in this example.

A number of different types of z-axis interconnectors have been proposed. One particularly advantageous type of z-axis interconnector is known as a "twist pin." Twist pin z-axis interconnectors are described in U.S. Pat. Nos. 5,014,419, 5,064,192, and 5,112,232, all of which are assigned to the assignee hereof.

An example of a prior art twist pin 50 is shown in FIG. 1. The twist pin 50 is formed from a length of wire 52 which has been formed conventionally by helically coiling a number of outer strands 54 around a center core strand 56 in a planetary manner, as shown in FIG. 2. At selected positions along the length of the wire 52, a bulge 58 is formed by untwisting the outer strands 54 in a reverse or anti-helical direction. As a result of untwisting the strands 54 in the anti-helical direction, the space consumed by the outer strands 54 increases, causing the outer strands 54 to bend or expand outward from the center strand 56 and create a larger diameter for the bulge 58 than the diameter of the regular stranded wire 52. The laterally outward extent of the bulge 58 is illustrated in FIG. 3, compared to FIG. 2.

The strands 54 and 56 of the wire 52 are preferably formed from beryllium copper. The beryllium copper provides necessary mechanical characteristics to maintain the shape of the wire in the stranded configuration, to allow the outer strands 54 to bend outward at each bulge 58 when untwisted, and to cause the bulges 58 to apply resilient radial contact force on the vias of the printed circuit boards. To facilitate and enhance these mechanical properties, the twist pin will typically be heat treated after it has been fabricated. Heat treating anneals or hardens the beryllium copper slightly and tempers the strands 54 at the bulges 58, causing enhanced resiliency or spring-like characteristics. It is also typical to plate the fabricated twist pin with an outer coating of gold. The gold plating establishes a good electrical connection with the vias. To cause the gold-plated exterior coating to adhere to the twist pin 50, usually the beryllium copper is first plated with a layer of nickel, and the gold is plated on top of the nickel layer. The nickel layer adheres very well to the beryllium copper, and the gold adheres very well to the nickel.

The bulges 58 are positioned at selected predetermined distances along the length of the wire 52 to contact the vias 60 in printed circuit boards 62 of a three-dimensional module 64, as shown in FIG. 4. Contact of the bulge 58 with the vias 60 is established by pulling the twist pin 50 through an aligned vertical column of vias 60 in the module 64. The outer strands 54 of the wire 52 have sufficient resiliency when deflected into the outward protruding bulge 58, to resiliently press against an inner surface of a sidewall 66 of each via 60, and thereby establish the electrical connection between the twist pin 50 and the via 60, as shown in FIG. 5. In those circumstances where an electrical connection is not desired between the twist pin 50 and the components of a printed circuit board, the via 60 is formed but no conductive traces connect the via to the other components of the printed circuit board. One such via 60' is shown in FIG. 4. The sidewall 66 of the via 60' extends through the printed circuit board, but the via 60' is electrically isolated from the other components on that printed circuit board because no traces extend beyond the sidewall 66. Inserting a bulge 58 of the twist pin 50 into a via 60' that is not connected to the other components of a printed circuit board eliminates an electrical connection from that twist pin to that printed circuit board, but establishes a mechanical connection between the twist pin and the printed circuit board which helps support and hold the printed circuit board in the three-dimensional module.

To insert the twist pins 50 into the vertically aligned vias 60 of the module 64 with the bulges 58 contacting the inner surfaces 66 of the vias 60, a leader 68 of the regularly-coiled strands 54 and 56 extends at one end of the twist pin 50. The strands 54 and 56 at a terminal end 70 of the leader 68 have been welded or fused together to form a rounded end configuration 70 to facilitate insertion of the twist pin 50 through the column of vertically aligned vias. The leader 68 is of sufficient length to extend through all of the vertically aligned vias 60 of the assembled stacked printed circuit boards 62, before the first bulge 58 makes contact with the outermost via 60 of the outermost printed circuit board 62. The leader 68 is gripped and the twist pin 50 is pulled through the vertically aligned vias 60 until the bulges 58 are aligned and in contact with the vias 60 of the stacked printed circuit boards. To position the bulges in contact with the vertically aligned vias, the leading bulges 58 will be pulled into and out of some of the vertically aligned vias until the twist pin 50 arrives at its final desired location. The resiliency of the strands 54 allow the bulges 58 to move in and out of the vias without losing their ability to make sound electrical contact with the sidewall of the final desired via into which the bulges 58 are positioned. Once appropriately positioned, the leader 68 is cut off so that the finished length of the twist pin 50 is approximately at the same level or slightly beyond the outer surface of the outer printed circuit board of the module 64. A tail 72 at the other end of the twist pin 50 extends a shorter distance beyond the last bulge 58. The strands 54 and 56 at an end 74 of the tail 72 are also fused together. The length of the tail 72 positions the end 74 at a similar position to the location where the leader 68 was cut on the opposite side of the module. However, if desired, the length of the tail 72 or the remaining length of the leader 68 after it was cut may be made longer or shorter. Allowing the tail 72 and the remaining portion of the leader 68 to extend slightly beyond the outer printed circuit boards 62 of the module 64 facilitates gripping the twist pin 50 when removing it from the module 64 to repair or replace any defective components. In those circumstances where it is preferred that the ends of the twist pin do not extend beyond the outside edges of the three-dimensional module, an overlay may be attached to the outermost printed circuit boards to make the ends of the twist pin flush with the overlay.

The ability to achieve good electrical connections between the vias 60 of the printed circuit boards depends on the ability to precisely position the location of the bulges 58 along the length of wire 52. Otherwise, the bulges 58 would be misaligned relative to the position of the vias, and possibly not create an adequate electrical connection. Therefore, it is important in the formation of the twist pins 50 that the bulges 58 be separated by predetermined intervals 76 (FIG. 1) along the length of the wire 52. The position of the bulges 58 and the length of the intervals 76 depend on the desired spacing between the printed circuit boards 62 of the module 64. The amount of bending of each of the outer conductors 54 at each bulge 58 must also be controlled so that each of the bulges 58 exercises enough force to make good electrical contact with the vias. Moreover, the amount of outward deflection or bulging of each of the bulges 58 must be approximately uniform so that none of the bulges 58 experiences permanent deformation when the bulge is pulled through the vias. Distortion-induced disparities in the dimensions of the bulges adversely affect their ability to make sound electrical connections with the vias 60. Further still, each twist pin 50 should retain a coaxial configuration along its length without slight angular bends at each bulge and without any bulge having asymmetrical characteristics. The coaxial configuration facilitates inserting the twist pin through the vertically aligned vias, maintaining the resiliency of the bulges, and establishing good electrical contact with the vias.

The requirements for close tolerances and precision in the twist pins are made more significant upon recognizing the very small size of the twist pins. The typical sizes of the most common sizes of helically-coiled wire are about 0.0016, 0.0033 and 0.0050 in. in diameter. The diameters of the strands 54 and 56 used in forming these three sizes of wires are 0.005, 0.0010, and 0.0015 in., respectively: The typical length of a twist pin having four to six bulges which extends through four to six printed circuit boards will be about 1 to 1.5 inches. The outer diameter of each bulge 58 will be approximately two to three times the diameter of the regularly stranded wire in the intervals 76. The tolerance for locating the bulges 58 between intervals 76 is in the neighborhood of 0.002 in. The weight of a typical four-bulge twist pin is about 0.0077 grams, making it so light that handling the twist pin is very difficult. Handling each twist pin is also complicated because its small dimensions do not easily resist the forces that are necessary to manually manipulate the twist pin without bending or deforming it. It is not unusual that a complex 4 in.×4 in. module 64 may require the use of as many as 22,000 twist pins. Thus, the relatively large number of twist pins necessary to assemble each three-dimensional module require an ability to fabricate a relatively large number of the twist pins in an efficient and rapid manner.

A general technique for fabricating twist pins is described in the three previously-identified U.S. patents. That described technique involves advancing the length of the stranded wire, clamping the stranded wire above and below the location where the bulge is to be formed, fusing the outer strands of the wire to the core strand of the wire preferably by laser welding at the locations above and below the bulge, and rotating the wire between the two clamps in an anti-helical direction to form the bulge.

In a prior art implementation of this twist pin fabrication technique, a wire feeder advanced an end of the helically stranded wire which was wound on a spool. The wire feeder employed a lead screw mechanism driven by an electric motor to advance the wire and unwind it from the spool. A solenoid-controlled clamp was connected to the lead screw mechanism to grip the wire as the lead screw mechanism advanced as much of the stranded wire from the spool as was necessary for use at each stage of fabrication of the twist pin. To advance more wire, the clamp opened and the lead screw mechanism retracted in a reverse movement. The clamp then closed again on the wire and the electric motor again advanced the lead screw mechanism.

While this prior art wire feeder mechanism was functional, the reciprocating movement of the feeder mechanism reduced efficiency and slowed the speed of operation. Half of the reciprocating movement, the return movement to the beginning position, was wasted motion. Moreover, the relatively high inertia and mass of the lead screw, clamp and motor armature required extra force and hence time to execute the reversing movements necessary for reciprocation. Furthermore, the rotational mass of the wire wound on the spool limited the acceleration rate at which the lead screw could unwind the wire off of the spool. The rotational mass was frequently sufficient enough to cause the wire to slip in the clamp carried by the lead screw. Slippage at this location resulted in the formation of the bulges at incorrect positions and incorrect lengths of the leader 68 and the internal lengths 76. The desire to avoid slippage also limited the operating speed of the fabricating equipment.

The prior art bulge forming mechanism included two clamping devices which closed on the wire above and below at the location where each bulge was to be formed. The clamping devices held a wire while a laser beam fused the outer strands 54 to the center core strand 56 at those locations. Thereafter, the lower clamping device was rotated in an anti-helical direction while the upper clamping device held the wire stationary, thereby forming the bulge 58.

The lower clamping device was carried by a sprocket, and the wire extended through a hole in the center of the sprocket. A first pneumatic cylinder was connected to the clamping device to cause the clamping device to grip the wire. A chain extended around the sprocket and meshed with the teeth of the sprocket. One end of the chain was connected to a spring, and the other end of the chain was connected to a second pneumatic cylinder. When the second pneumatic cylinder was actuated, its rod and piston pulled the chain to rotate the sprocket by the amount of the piston throw. Upon reaching the end of its throw, the rod and cylinder of the second pneumatic cylinder was returned in the opposite direction to its original position by the force of the spring which pulled the chain in the opposite direction. Of course, moving the chain to its original position also rotated the sprocket in the opposite direction to its original position.

After gripping the wire by activating the first pneumatic cylinder, the second pneumatic cylinder was activated to rotate the sprocket in the anti-helical direction. However, the throw of the second pneumatic cylinder, and the amount of rotation of the sprocket, was insufficient to completely form a bulge with a single rotational movement. Instead, two of separate rotational movements were required to completely form the bulge. After the rotation, the lower clamping device released its grip on the wire while the sprocket rotated in the reverse direction. Upon rotating back to the initial position again, the lower clamping device again gripped the wire and another rotational movement of the sprocket and gripping device was executed to finish forming the bulge.

By providing only a limited amount of rotational movement so as to require two rotations to form the bulge, a significant amount of time was consumed in forming each bulge. The latency of reversing the movement of the components and executing multiple bulge forming movements slowed the fabrication rate of the twist pins. The rotational mass of the sprocket and the clamping mechanism with its attached solenoid activation clamping device reduced the rate at which these elements could be accelerated, and also constituted a limitation on the speed at which twist pins could be fabricated. Apart from the rotational mass issues, acceleration had to be limited to avoid inducing wire slippage. The need to reverse the direction of movement of numerous reciprocating components limited the rate at which the twist pins bulges could be fabricated.

After formation of the bulges in the prior art twist pin fabricating machine, the wire with the formed bulges was cut to length to form the twist pin. The leader of the twist pin extended into a venturi through which gas flowed. The effect of the gas flowing through the venturi was to induce a slight tension force on the wire, and hold it while a laser beam severed the wire at the desired length. The laser beam fused the ends 70 and 74 of the strands 54 and 56 as it severed the fabricated twist pin from the length of wire. The tension force induced on the wire by the gas flowing through the venturi propelled the twist pins into a random pile called a "haystack." After a sufficient number of twist pins had accumulated, they were placed into a separate sorting and singulating machine which ultimately delivered the twist pins one at a time in a specific orientation into a carrier. The pins were later heat treated and transferred from the carrier and inserted into the three-dimensional modules.

The process of sorting the twist pins, orienting them, delivering them into the carrier, and making sure that the twist pins were received properly within the carrier required considerable human intervention and machine handling after the twist pins were fabricated. Occasionally the twist pins would be lodged in tubes which guided the twist pins into the carrier by an air flow. Delivering the twist pins into the receptacles in the carrier was also difficult, and human intervention was required to assure that the twist pins were properly received in the receptacles. Twist pin sorting also occasionally resulted in jamming and bending the twist pins. In general, the post-fabrication processing steps required to organize the twist pins for their subsequent use contributed to overall inefficiency.

These and other considerations pertinent to the fabrication of twist pins have given rise to the new and improved aspects of the present invention.

SUMMARY OF THE INVENTION

One improved aspect of the present invention involves withdrawing wire from a source, such as a spool, and advancing that wire to be used in fabricating twist pins in the such a manner that twist pins can be more rapidly and more efficiently fabricated compared to previous techniques. Another improved aspect of the present invention involves fabricating twist pins having more uniform and precisely controlled characteristics, such as more precisely positioned bulges and leaders, tails and intervals of more precisely controlled dimensions. Another improved aspect of the present invention involves feeding the wire and fabricating twist pins without using reciprocal motions. The lost motion of return strokes and the latency associated with reciprocation decreases the speed of fabricating the twist pins. The necessity to accelerate relatively massive components is avoided by using continuous movements or intermittent movements which do not involve changes of direction and which tend to conserve energy and momentum without requiring acceleration of massive components. Another improved aspect is that the nature of the movements involved does not tend to induce slippage of the wire during the fabrication of the twist pin. Other aspects of the present invention allow the constituent components of the twist pin to be more precisely fabricated into the desired shapes, dimensions and tolerances, while still allowing twist pins of different sizes to be fabricated.

In one principal regard, the present invention involves a wire feed mechanism for receiving wire from a wire source and advancing the wire to be used as an electrical connector. The wire feed mechanism comprises a cavity within which to receive wire from the source, a wire-supplying device which supplies wire from the source into the cavity and maintains an amount of slack wire within the cavity, and a wire-advancing device which withdraws a predetermined amount of the slack wire from the cavity and advances that predetermined amount of wire to be used for the electrical connector.

In another principal regard, the present invention involves a wire feed mechanism for receiving wire from a source and advancing the wire to be used as an electrical connector. In this instance, the wire feed mechanism comprises a cavity within which to receive wire from the source, a wire-supplying device which supplies wire from the source into the cavity, a sensor located in the cavity to sense a predetermined amount of slack wire within the cavity, and a controller responsive to the sensor to control the supply of additional wire from the source into the cavity to establish and maintain the predetermined slack amount of wire within the cavity.

In yet another principal regard, the present invention involves a method of withdrawing wire from a wire source and advancing the withdrawn wire for use as an electrical connector. The method comprises the steps of withdrawing a sufficient amount of wire from the wire source to form a predetermined length of slack wire, configuring the slack wire into a predetermined configuration, advancing slack wire from the predetermined configuration for use as the electrical connector, and supplying additional wire from the wire source to compensate for the slack wire advanced from the predetermined configuration to maintain the predetermined configuration of slack wire.

Certain preferred aspects of the invention involve advancing the slack wire from the cavity in predetermined interval lengths and limiting the length of an interval to an amount of wire less than the amount of slack wire in the cavity. Preferably, the additional wire from the source is applied to the cavity at a faster rate than the slack wire is advanced from the predetermined configuration within the cavity. The wire is supplied to the cavity independently of advancing the wire from the cavity. The mass and inertia effects of withdrawing the wire from the wire source are isolated by the slack wire within the cavity from the mass and inertia effects associated with advancing the slack wire from the cavity. Slippage is avoided because the advancement of the wire needs only to overcome the considerably reduced mass and inertia effects of the slack wire in the cavity, rather than to overcome the considerably greater mass and inertia effects of withdrawing the wire from the source. This is particularly the case when the wire source is a spool upon which the wire has been wound, and to unwind the wire from the spool requires that the entire mass of wire wound on the spool be rotated.

Other preferred aspects of the present invention involve sensing a characteristic of the slack wire configuration to maintain the slack wire in the configuration. Preferably the slack wire configuration involves bending the wire within the cavity into at least one curve, and more preferably into an S-shaped configuration having two curves. The amount of wire supplied, the amount of withdrawn wire advanced and the dimensions of the cavity limit the curvature of each man in the wire to avoid permanently set or deforming the wire. A characteristic, such as the position, of at least one and preferably both of the curves is sensed, and the additional wire is supplied in response. For example, bar-type position sensors may be used to determine the contact of the curved wire. If the two curves of wire in the S-shaped configuration do not contact the bar-type sensors, additional wire is supplied until the amount of slack wire in the cavity widens the S-shaped configuration to place the curves in contact with the sensors. The S-shaped configuration is thereby maintained even while advancing the slack wire from the S-shaped configuration.

The additional wire is preferably supplied by roller that makes frictional contact with the wire from the source. A motor rotates the roller to avoid inefficient, time-consuming and problematic reciprocating movements. The motor driving the wire-supplying roller is preferably a conventional direct-current (DC) motor which is driven by a power control signal. The power control signal preferably has a repeating duty cycle characteristic defining an on-time during which power is supplied and an off-time during which power is not supplied. A speed reducing gear head may connect the motor to the roller. Using a power control signal with a duty cycle characteristic to energize the motor allows close control over the wire advanced because of the ability to control and avoid rotational inertia or wind-down effects. Consequently, an excessive amount of additional wire is not supplied into the cavity, but only a sufficient amount is supplied to maintain the predetermined configuration.

The wire is preferably advanced from the cavity by a spindle which is positioned in frictional contact with the wire and which is rotated by a spindle drive motor. Preferably the spindle drive motor is a stepper motor which allows a precise and fine resolution of wire to be advanced from the cavity by electronically controlling the number of energizing pulses supplied to the drive motor. Precise advancement of the wire is desirable because the advancement of the wire locates the position at which the characteristics of the electrical connector, such as the bulges on a twist pin, are formed.

The present invention is preferably used in cooperation with fabricating an electrical connector having bulges formed in a wire formed from helically coiled strands. The wire is gripped and rotated in an anti-helical direction to untwist the strands and form the bulge. The advancement of the wire locates the position where the bulges formed. The advancement of the wire also locates the position where the wire is to be severed to separate a segment of the wire having the bulges from the remaining wire, thereby completing the fabrication of the twist pin.

By separately uncoiling the wire from the spool to form the slack wire configuration and then advancing the wire from the slack wire to form the connector, the mass and rotational inertia effects twist pin electrical conductors can be manufactured more rapidly and efficiently. The position of the bulges another characteristics of the twist pin are more uniformly established, because wire slippage is less likely when advancing the wire from the amount of slack wire. The wire supplied from the spool and advanced by separately controlled actions which do not involve the inefficiency and latency associated with reciprocal actions. The lost motion of return strokes and the latency associated with reciprocation decreases the speed of fabricating the twist pins. Using rollers and spindle is to advance the wire avoids the necessity to accelerate and decelerate relatively massive components.

A more complete appreciation of the present invention and its scope may be obtained from the accompanying drawings, which are briefly summarized below, from the following detailed descriptions of presently preferred embodiments of the invention, and from the appended claims.

DETAILED DESCRIPTION

Figure 6:
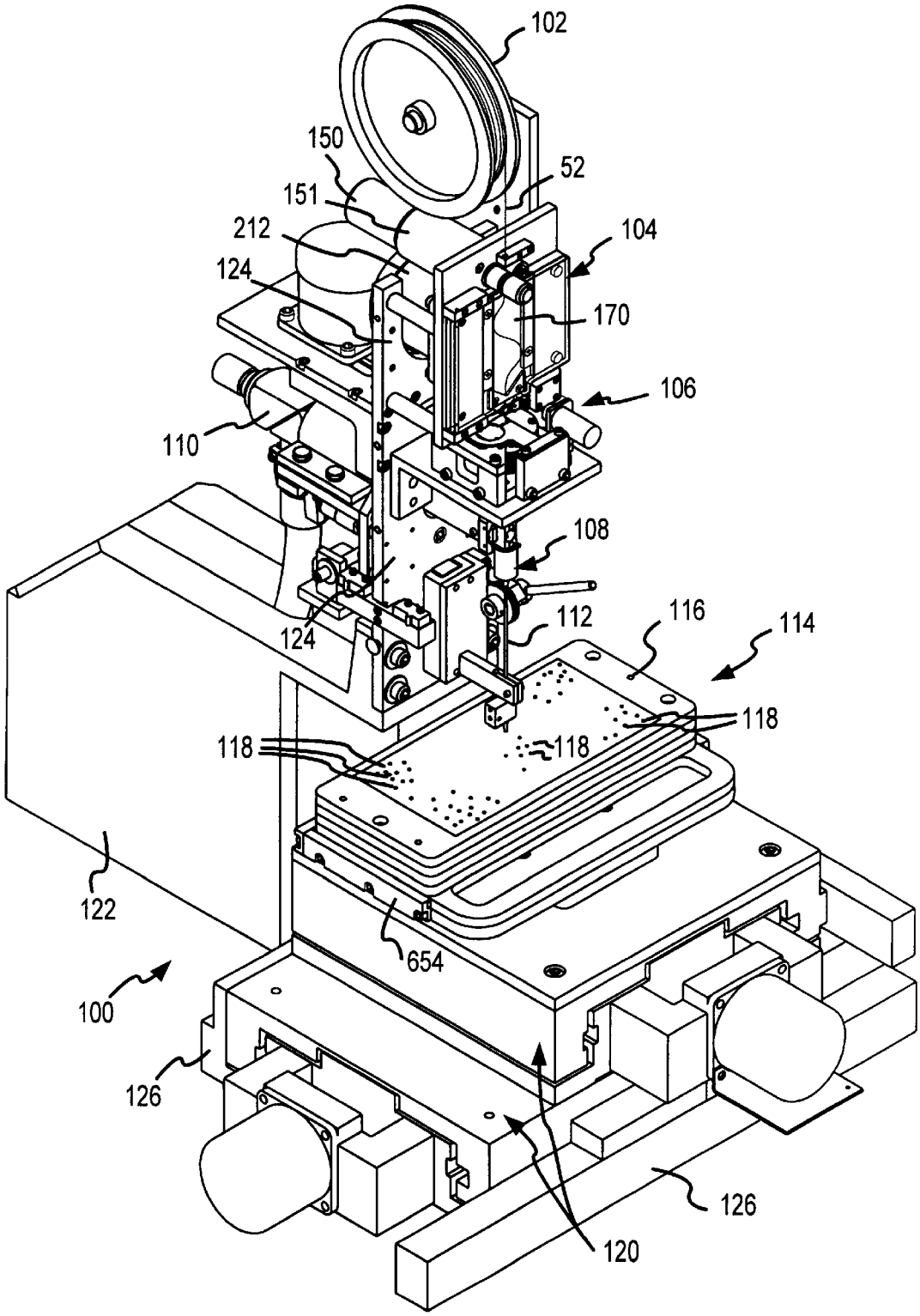
FIG. 6 is a perspective view of a machine for fabricating twist pins of the type shown in FIG. 1, in accordance with the present invention.

The present invention is preferably incorporated in an improved machine 100 which fabricates twist pins 50 (FIG. 1), and in improved methodology for fabricating twist pins, as shown and understood by reference to FIG. 6. The twist pins are fabricated from the gold-plated, beryllium-copper wire 52 which is wound on a spool 102. A wire feed mechanism 104 of the machine 100 unwinds the wire 52 from the spool 102 and accurately feeds the wire to a bulge forming mechanism 106 which is located below the wire feed mechanism 104. The bulge forming mechanism forms the bulges 58 (FIG. 1) at precise locations along the length of the wire 52. The positions where the bulges 58 are formed is established by the advancement of the wire 52 by the wire feed mechanism 104. The bulge forming mechanism 106 forms the bulges by gripping the wire 52 and untwisting the wire in the reverse or anti-helical direction.

After all of the bulges of the twist pin 50 (FIG. 1) have been formed by the bulge forming mechanism 106, the wire feed mechanism 104 advances the twist pin configuration formed in the wire 52 into a pneumatic inductor mechanism 108. With the twist pin positioned in the inductor mechanism 108, the end 74 of the tail 72 or the end 70 of the leader 68 (FIG. 1) of the twist pin configuration is located below the bulge forming mechanism 106. A laser beam device 110 is activated and its emitted laser beam melts the wire 52 at the ends 70 and 74 (FIG. 1), thus completing the formation of the twist pin 50 by severing the fabricated twist pin from the remaining wire 52.

Figure 4:
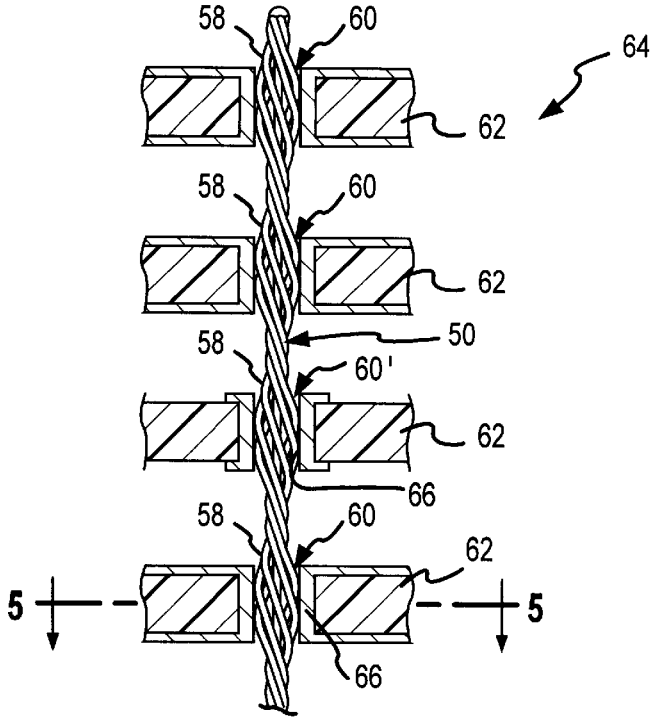
FIG.4 PRIOR ART
FIG. 4 is a partial, vertical cross-sectional view of a prior art three-dimensional module, formed by multiple printed circuit boards and illustrating a single twist pin of the type shown in FIG. 1 extending through vertically aligned vias of the printed circuit boards of the module.
Figure 5:
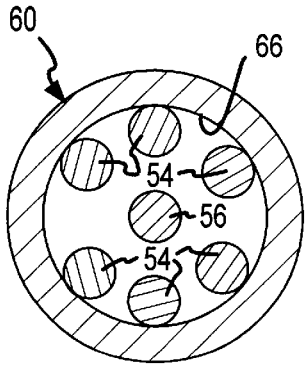
FIG.5 PRIOR ART
FIG. 5 is an enlarged cross-sectional view of the twist pin within a via shown in FIG. 4, taken substantially in the plane of line 5—5 shown in FIG. 4.

The severed twist pin is released into the pneumatic inductor mechanism 108. The inductor mechanism 108 applies a slightly negative relative gas or air pressure or suction to the twist pin, and creates a gas flow which conveys the severed twist pin downward through a tube 112 of a twist pin receiving mechanism 114. The twist pin receiving mechanism 114 includes a cassette 116 into which receptacles 118 are formed in a vertically oriented manner. The tube 112 of the inductor mechanism 108 delivers one twist pin into each of the receptacles 118. Once a twist pin occupies one of the receptacles 118, an x-y movement table 120 moves the cassette 116 to position an unoccupied receptacle 118 beneath the tube 112. The x-y movement table 120 continues moving the cassette 116 in this manner until all of the receptacles 118 have been filled with fabricated twist pins. Once the cassette 116 has been filled with twist pins, the filled cassette is removed and replaced with an empty cassette, whereupon the process continues. Later after heat treatment, the fabricated twist pins are removed from the cassette 116 and inserted into the vias 60 to form the three-dimensional module 64 (FIG. 4).

The operation of the wire feed mechanism 104, the bulge forming mechanism 106, the inductor mechanism 108, the laser beam device 110 and the twist pin receiving mechanism 114 are all controlled by a machine microcontroller or microcomputer (referred to as a "controller," not shown) which has been programmed to cause these devices to execute the described functions. The spool 102, the wire feed mechanism 104, the bulge forming mechanism 106, the inductor mechanism 108 and the laser beam device 110 are interconnected and attached to a first frame element 122. A support plate 124 extends vertically upward from the first frame element 122, and the wire feed mechanism 104, the bulge forming mechanism 106 and the inductor mechanism 108 are all connected to or supported from the support plate 124. The twist pin receiving mechanism 114 is connected to a second frame element 126. Both frame elements 122 and 126 are connected rigidly to a single structural support frame (not shown) for the entire machine 100. All of the components shown and described in connection with FIG. 6 are enclosed within a housing (not shown).

More details concerning the twist pin fabricating machine 100 and method of fabricating twist pins are described in the above-referenced and concurrently-filed U.S. patent application, Ser. No. 09/782,987. Details concerning the improved wire feed mechanism 104 and the improved method of moving wire in accordance with the present invention are described below.

As shown in FIGS. 7–10, the wire feed mechanism 104 includes a pre-feed electric motor 150 and a connected, speed-reducing gear head 151. A capstan 152 is connected to and rotated by the gear head 151. The gear head 151 is rotated by the electric motor and reduces the rotational speed of the motor 150. An idler roller 154 is located adjacent to and in contact with the outer surface of the capstan 152. The wire 52 extends between the capstan 152 and the roller 154. Both of the outer surfaces of the capstan 152 and the roller 154 are formed with resilient material which slightly deforms around the wire 52 to apply sufficient frictional force on the wire 52 to firmly grip the wire between the capstan 152 and the roller 154 and to advance the wire without slippage when the capstan 152 is rotated. Rotating the capstan 152 to advance the wire 52 also unwinds wire 52 from the spool 102 (FIG. 6).

A guide block 156 defines a hole 158 which guides the wire 52 from the spool to a position between the capstan 152 and the roller 154. The gear head 151, a shaft 160 (FIG. 8) upon which the idler roller 154 rotates, and the guide block 156 are all connected to a back plate 162. All of the other components of the wire feed mechanism 104 are also connected to the back plate 162, except the electric motor 150 which is connected to the gear head 151. The back plate 162 is connected by spacers 164 to the support plate 124 (FIG. 6).

Figure 8:
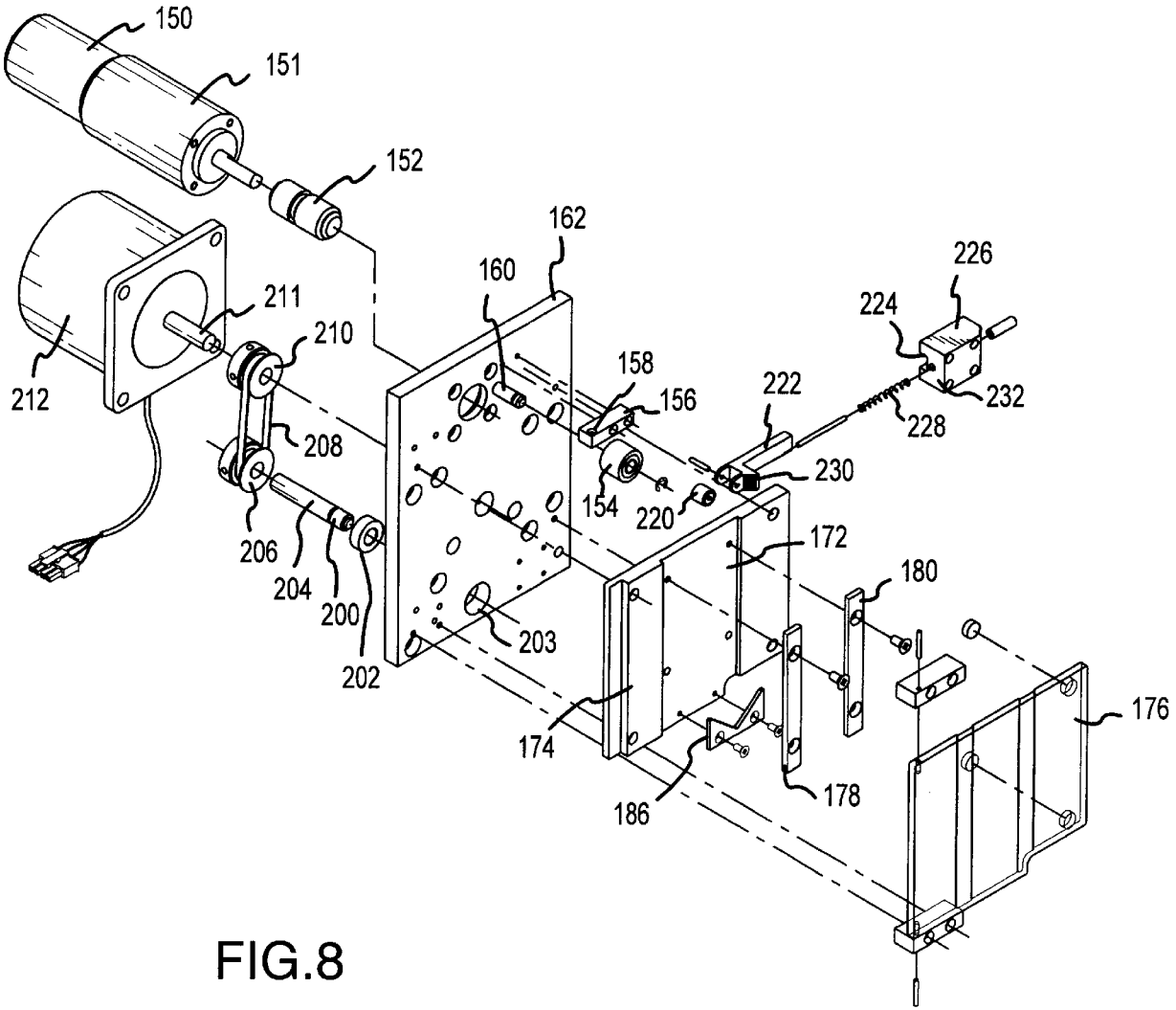
FIG. 8 is an enlarged, exploded perspective view of the wire feed mechanism shown in FIGS. 6 and 7.
Figure 9:
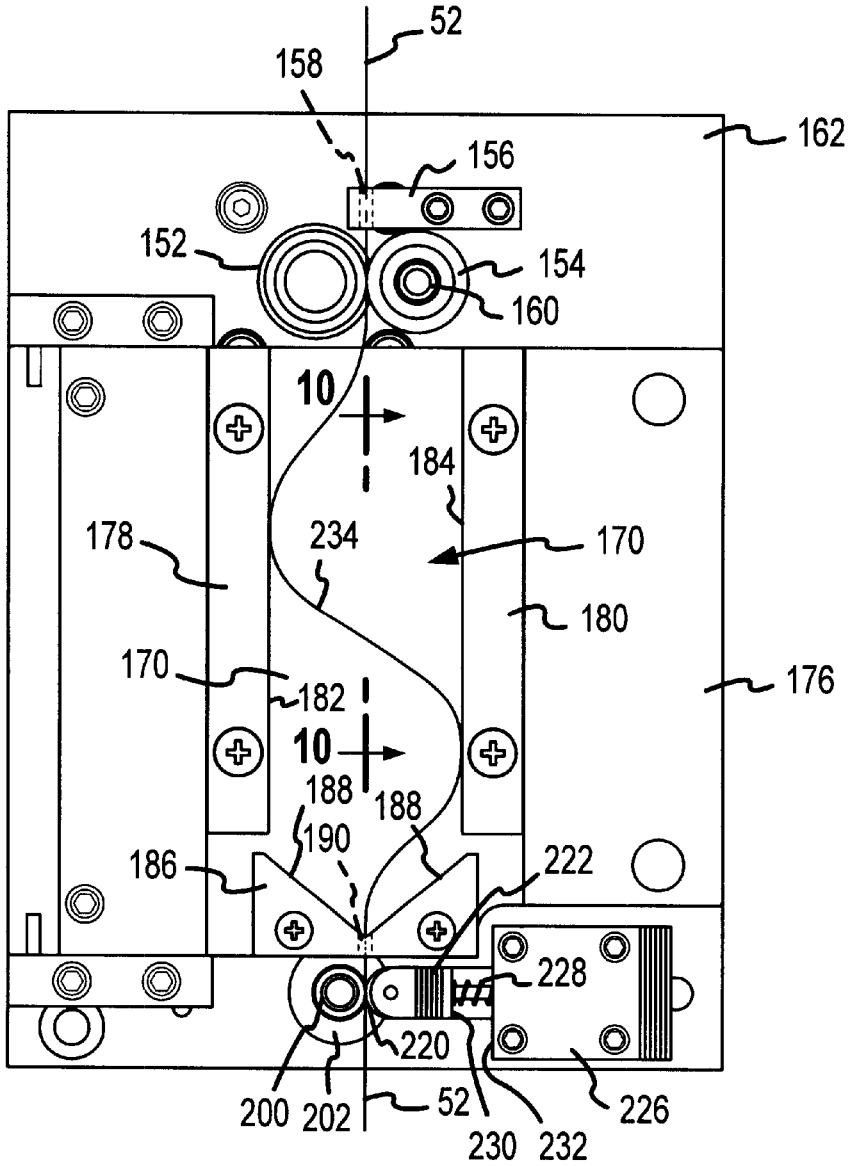
FIG. 9 is an enlarged front elevational view of the wire feed mechanism shown in FIGS. 7 and 8.
Figure 10:
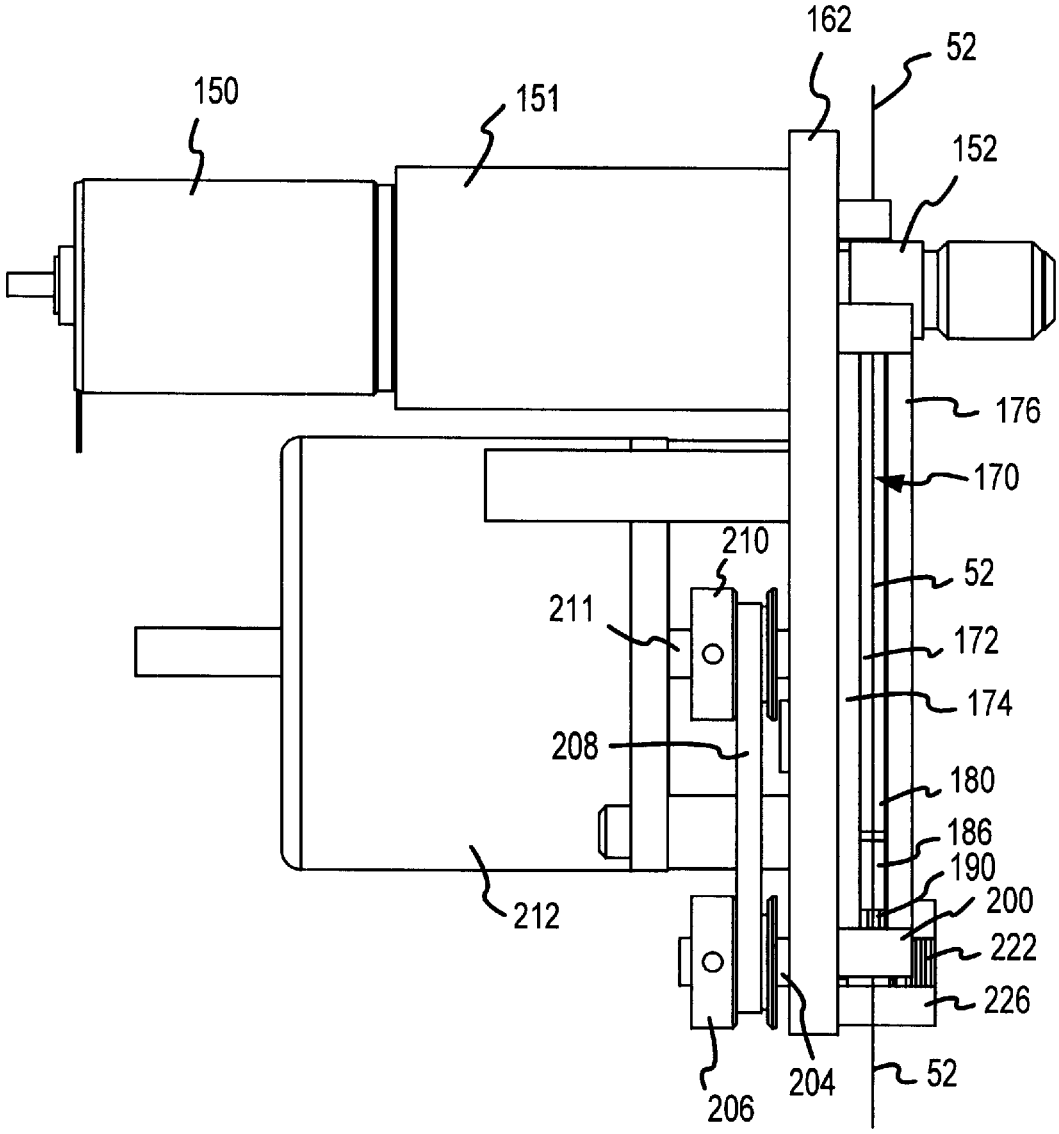
FIG. 10 is a side elevational view of the wire feed mechanism shown in FIG. 9, with a cavity thereof shown sectionally in a view taken substantially in the plane of line 10—10 of FIG. 9.

The rotating capstan 152 advances the wire 52 into a cavity 170. The cavity 170 is defined in part by a vertically-extending, wide rectangular recess 172 (FIG. 8) formed in a rear facing plate 174. The rear facing plate 174 is made of an electrically insulating material and is attached to the back plate 162. A front transparent door 176 covers the recess 172 and forms a front boundary of the cavity 170. The door 176 is hinged to the rear facing plate 174, on the left-hand side of the facing plate 174 as shown in FIGS. 8 and 9. The door 176 is also made of electrically insulating material. Vertically extending contact bars 178 and 180 are positioned on the opposite lateral sides (FIG. 9) of the recess 172. The contact bars 178 and 180 are made from electrically conductive material. The electrically conductive contact bars 178 and 180 are connected to the electrically insulating facing plate 174 in a manner which electrically isolates each of the contact bars 178 and 180 from each other and from the back plate 162. Inside edges 182 and 184 of the contact bars 178 and 180, respectively, define the lateral outside edges of the cavity 170. A cavity exit guide 186 is located at the bottom of the cavity 170. The cavity exit guide 186 includes two downward and inward sloping surfaces 188 which join at an exit hole 190 (FIG. 9). The exit hole 190 extends vertically downward through the cavity guide 186 at a position which is directly vertically below the contact point of the pre-feed capstan 152 and the roller 154 and directly above the point where the wire 52 enters the bulge forming mechanism 106.

The wire 52 is withdrawn from the cavity 170 by rotating a wire feed spindle 200. The wire feed spindle 200 is rotationally supported by a bearing 202 which fits within a hole 203 (FIG. 8) formed in the back plate 162. A shaft 204 of the spindle 200 extends on the rear side of the back plate 162. A pulley 206 is connected to the shaft 204 on the rear side of the back plate 162. The pulley 206 and the spindle 200 are rotated by a toothed timing belt 208 which extends between the pulley 206 and a pulley 210. The pulley 210 is connected to the output shaft 211 of a precision feed motor 212. When the feed motor 212 is energized, the pulley 210 rotates the timing belt 208 which in turn rotates the pulley 206 and the spindle 200.

A pinch roller 220 is biased against the spindle 200 by the force applied from a plunger 222. The plunger 222 is movably positioned within a slot 224 formed in a plunger guide block 226. The plunger 222 and the pinch roller 220 are biased outward from the plunger guide block 226 toward the spindle 200 by a spring 228. The spring 228 extends between a shoulder 230 formed on the plunger 222 and a surface 232 of the guide block 226. The exterior surfaces of the spindle 200 and the pinch roller 220 are slightly resilient to establish good frictional contact with the wire 52. The force of the spring 228 causes sufficient frictional contact of the wire 52 between the spindle 200 and the pinch roller 220 to precisely advance the wire 52 by an amount determined by the rotation of the precision feed motor 212.

Figure 1:
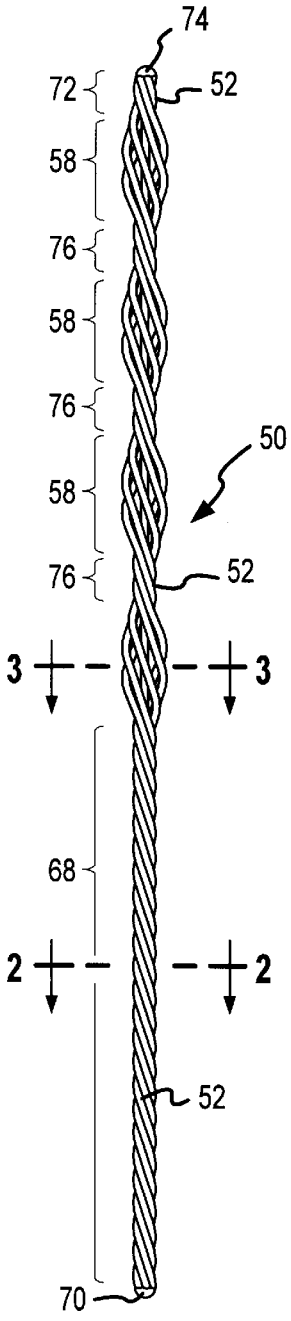
FIG.1 PRIOR ART
FIG. 1 is a side elevational view of a prior art twist pin.
Figure 2:
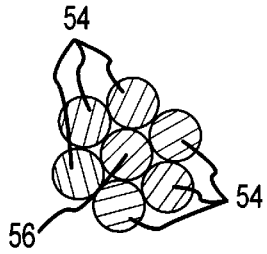
FIG.2 PRIOR ART
FIG. 2 is an enlarged, cross-sectional view of the twist pin shown in FIG. 1, taken substantially in the plane of line 2—2 shown in FIG. 1.
Figure 3:
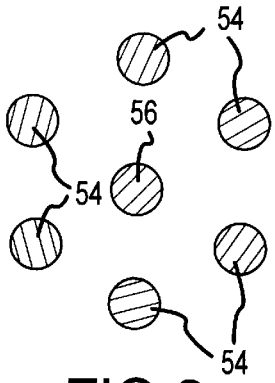
FIG.3 PRIOR ART
FIG. 3 is an enlarged, cross-sectional view of the twist pin shown in FIG. 1, taken substantially in the plane of line 3—3 shown in FIG. 1.

One of the important improvements available from the wire feed mechanism 104 is the ability to unwind wire 52 from the spool 102 (FIG. 6) in such a manner that the rotational inertia of the spool and the mass of the wire withdrawn from the spool do not induce slipping of the wire. Wire slippage can result in adverse positioning of the bulges 58, or incorrect lengths of the leader 68, the tail 72 or the intervals 76 between the bulges (FIG. 1). This improvement has been achieved in significant part by unwinding the wire 52 from the spool 102 independently of the advancement of the wire into the bulge forming mechanism 106, where the lengths and positions of the components of the twist pin 50 are established.

Withdrawing the wire from the spool independently of advancing the wire is achieved by operating the pre-feed motor 150 and pre-feed capstan 152 independently of operating the precision feed motor 212 and the spindle 200, and by accumulating an amount of slack wire in the cavity 170. The pre-feed motor 150 and the capstan 152 advance wire into the cavity 170 until a slack, S-shaped configuration 234 of the wire 52 is accumulated in the cavity 170. The S-shaped configuration 234 consumes enough slack wire within the cavity to form at least one twist pin. Moreover the slack wire of the S-shaped configuration 234 is not under tension or resistance from the spool 102 (FIG. 6), thereby allowing the wire 52 to be advanced precisely from the cavity 170 into the bulge forming mechanism 106 by the precision feed motor 212 and the spindle 200.

The slack amount of wire consumed by the S-shaped configuration 234 in the cavity 170 exhibits very little inertia and mass, thereby allowing the precision feed motor 212 and spindle 200 to advance a desired amount of wire quickly, without having to overcome the adverse influences of attempting to accelerate a significant mass of wire, accelerate the rotation of the spool 102, or to overcome significant inertia of the wire on the spool and the spool while unwinding the wire.

The effects of high mass under high acceleration conditions, and the effects of inertia, can induce slippage in the wire as it is advanced under high speed manufacturing conditions, thereby resulting in forming the bulges 58 at incorrect positions and in undesired lengths of the leader 68, the tail 72 and the interval 76 of the twist pin 50. As the wire in the cavity 170 is fed out by the precision feed motor 212 and spindle 200, the prefeed motor 150 and the capstan 152 feed more wire into the cavity to maintain the S-shaped configuration 234.

The prefeed motor 150 is energized and operates to advance wire from the spool into the cavity until bends of the S-shaped configuration 234 contact the edges 182 and 184 of the contact bars 178 and 180. When the bends of the S-shaped configuration 234 contact both contact bars 178 and 180, the power to the pre-feed motor 150 is terminated. Thereafter, as the precision feed motor 212 and spindle 200 withdraw wire from the cavity 170, causing the S-shaped configuration 234 to become narrower and withdraw the bends of the S-shaped configuration from contact with the edges 182 and 184 of the contact bars 178 and 180, power is again supplied to the prefeed motor 150 to advance more wire into the cavity 170 until the S-shaped configuration is re-established. The pre-feed motor 150 advances the wire into the cavity 170 at a faster rate than the wire is withdrawn by the precision feed motor 212, causing the wire within the cavity 170 to maintain the S-shaped configuration 234.

Figure 7:
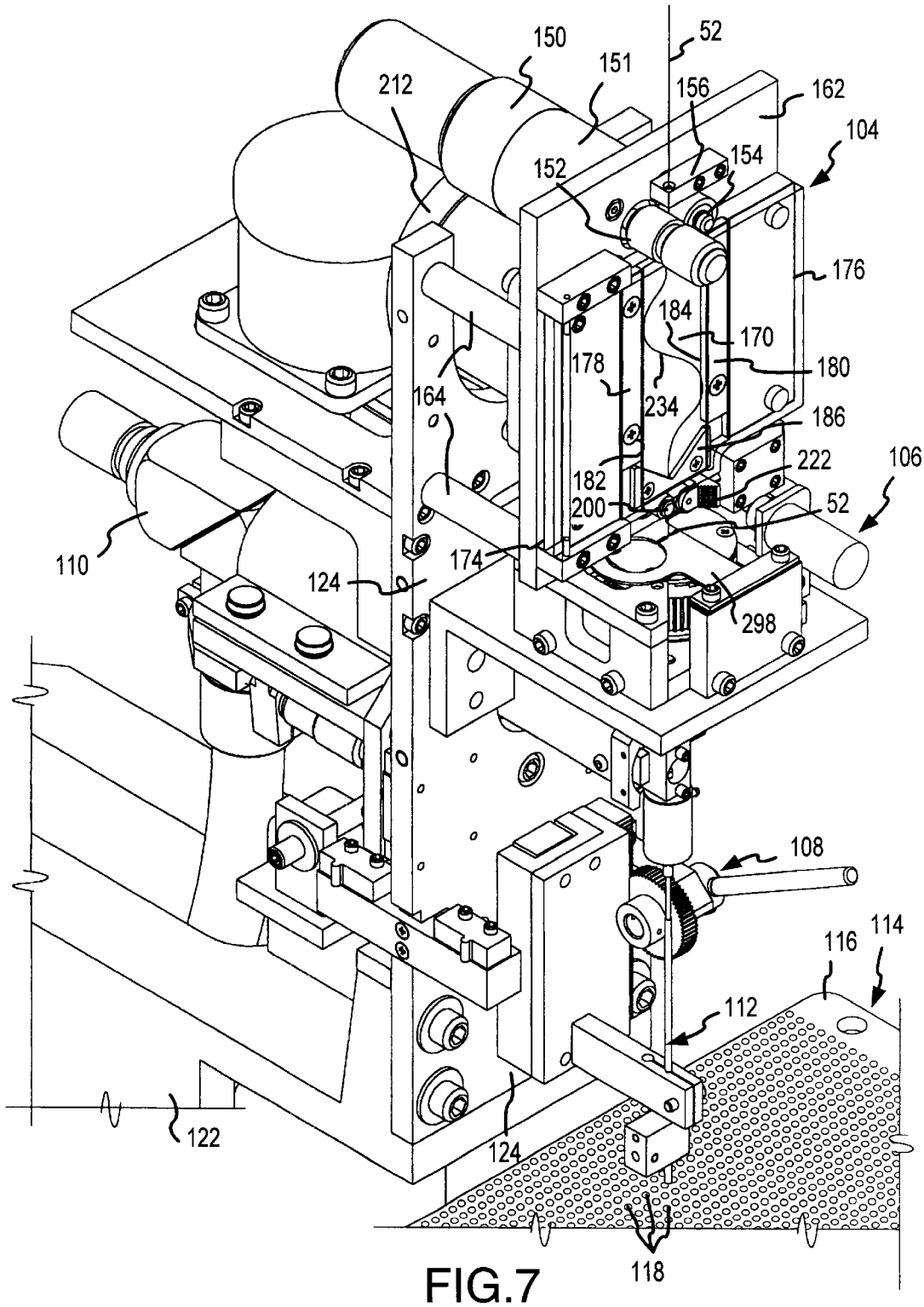
FIG. 7 is an enlarged perspective view of a wire feed mechanism, a bulge forming mechanism, an inductor mechanism and a portion of a twist pin receiving mechanism of the twist pin fabricating machine shown in FIG. 6.
Figure 11:
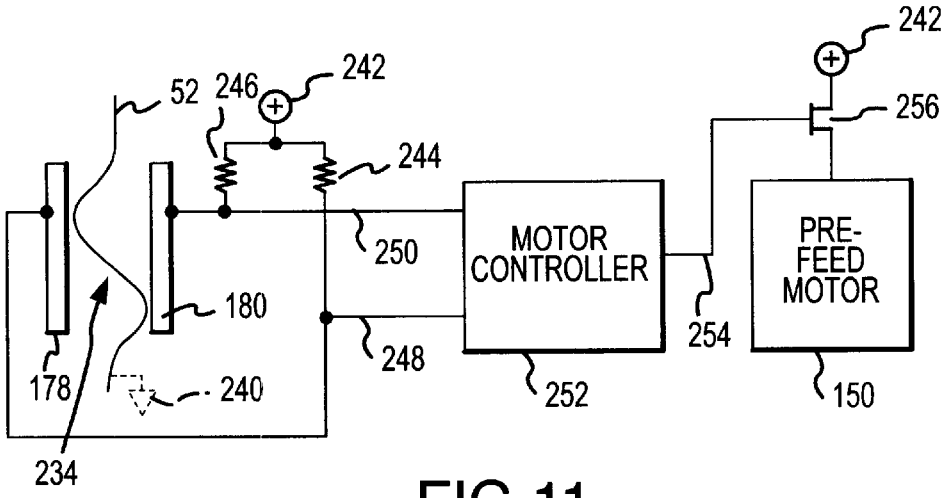
FIG. 11 is a schematic and block diagram of a control system for a pre-feed motor of the wire feed mechanism shown in FIGS. 7–10.

The manner in which the pre-feed motor 150 is energized to cause slack wire in the cavity 170 to assume the S-shaped configuration 234 is understood by reference to FIG. 11 taken in connection with FIG. 9. The wire 52 fed into the cavity 170 is electrically connected to reference potential 240 as a result of the electrical contact of the wire with the grounded bulge forming mechanism 106 (FIG. 7). Each of the contact bars 178 and 180 are electrically isolated from the reference potential 240 and are normally connected to a logic-high level voltage 242 through resistors 244 and 246, respectively. Each of the contact bars 178 and 180 are also connected by conductors 248 and 250, respectively, to a motor controller 252. When the wire 52 does not contact either of the contact bars 178 or 180, the signals on the conductors 248 and 250 are at a logic-high level, due to their connection through the resistors 244 and 246 to the logic-high level potential 242. The motor controller 252 interprets the two logic-high signals at 248 and 250 as a condition to apply a power control signal at 254. The presence of the power control signal 254 biases a transistor 256 or other control switch device to conduct current to the pre-feed motor 150. The pre-feed motor rotates and wire 52 is unwound from the spool 102 (FIG. 6) and advanced into the cavity 170 (FIG. 9).

When a sufficient amount of wire has been advanced into the cavity 170 to cause the wire to contact one of the contact bars, for example contact bar 178, the reference-potential of the wire 52 causes the signal at 248 to assume a logic-low level. Under these conditions, the motor controller 252 senses a logic-high level signal at 250 and a logic-low level signal at 248. The motor controller 252 continues to deliver the power control signal 254 under these conditions, causing the pre-feed motor 150 to continue to operate. However, when the S-shaped configuration 234 continues to widen so that the wire 52 also bends into electrical contact with the other one of the contact bars, 180 in this example, the control signal 250 assumes a logic-low level. Under these conditions, the motor controller 252 stops supplying the power control signal 254, and the pre-feed motor 150 ceases operation.

When the precision feed motor 212 has advanced enough wire from the cavity 170 to cause one or both of the bends of the S-shaped configuration 234 to withdraw from contact with one of the contact bars 178 or 180, one or both of the control signals 248 or 250 again assumes a logic-high level. When one or both of the control signals 248 or 250 assumes a logic-high level, the motor controller 252 resumes the delivery of the power control signal 254. The pre-feed motor 150 again responds to the assertion of the power control signal 254 to unwind more wire from the spool into the cavity 170, until the bends of the S-shaped configuration 234 again make electrical contact with the contact bars 178 and 180. The pre-feed motor 150 will feed wire into the cavity 170 at a greater rate than the precision feed motor 212 will advance wire from the cavity 170. This difference in relative wire advancement rates of the motors 150 and 212, and the control arrangement just described, assures that sufficient slack wire will be fed into the cavity in the form of the S-shaped configuration 234 at all times, even though the bends of the S-shaped configuration 234 may not contact the contact bars 178 and 180 continuously.

Figure 12:
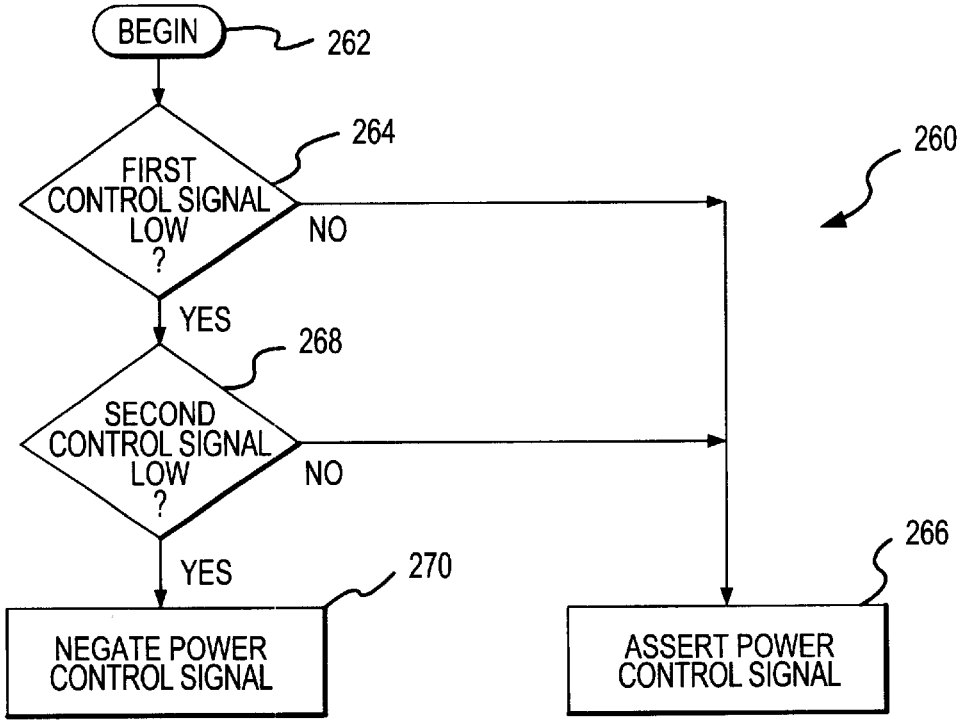
FIG. 12 is a flowchart of the steps executed by the control system shown in FIG. 11.

The overall functionality achieved by the wire position sensing arrangement of the contact bars 178 and 180 and the motor controller 252 is shown in FIG. 12 in the form of a flowchart of the steps involved in a control procedure 260 accomplished by the motor controller 252. The steps of the control procedure 260 begin at 262. At 264, a determination is made whether the first control signal 248 is at a logic-low level. A logic-low level control signal 248 represents the condition where a bend of the S-shaped configuration 234 of wire 52 has contacted the contact bar 178. Until such time as a bend of the S-shaped configuration 234 contacts the contact bar 178, the control signal 248 maintains a logic-high level and the motor controller 252 continues to assert the power control signal 254 at step 266. However, once a bend of the S-shaped configuration 234 contacts the control bar 178 and the control signal 248 assumes a logic-low level as determined at step 264, another determination is made at step 268 as to whether the second control signal 250 has assumed a logic-low level. Until such time as the second control signal 250 has assumed a logic-low level because of a bend of the S-shaped configuration 234 contacting the contact bar 180, the motor controller 252 asserts the power delivery signal 254. Thus, even though the determination at step 264 indicates that the first control signal 248 is at a logic-low level indicating contact with the contact bar 178, the power control signal 254 will be asserted at step 266 until such time as the second control signal 250 has assumed a similar logic-low level. However, two affirmative determinations at steps 264 and 268 cause the power control signal 254 to be negated, as indicated at step 270. The negation of the power control signal 254 at step 270 causes the termination of delivery of power to the pre-feed motor 150, which causes the pre-feed motor 150 to stop rotating.

The lateral width of the cavity 170 in the horizontal dimension and the height of the cavity 170 in the vertical dimension, as shown in FIG. 9, are established in relation to the natural column deflection or bend characteristics of the wire 52. The lateral width and height of the cavity 170 should be sufficient to allow the accumulation of enough slack wire in the S-shaped configuration 234 to avoid creating tension in the wire passing through the cavity 170 as that wire is advanced by the precision feed motor 212. Preferably, the lateral width and height of the cavity 170 is also sufficient to accumulate enough slack wire to form at least one twist pin from the wire in the cavity. However, the lateral width should not be so great, and the vertical height should not be so small as to induce sharp bends in the wire 52 that would cause the wire to assume a permanent set or deformation. A permanent set or deformation would cause a bend in the wire that would adversely influence its linear advancement through the bulge forming mechanism 106, thereby resulting in a nonlinear or non-coaxial twist pin or the formation of bulges 58 which are not symmetrical about the axis of the twist pin.

On the other hand, the lateral width and vertical height of the cavity should not be so great as to permit more than two bends (one S-shaped configuration 234) to occur, because otherwise some complex shape other than the S-shaped configuration 234 would be formed in the cavity. Some other complex shape, such as a FIG. 8 shape, a circle shape, or some random geometric shape, might result in the wire not touching one of the contact bars 178 or 180, or could cause a permanent deformation or set in the wire due to short radius bends or in tightening of those bends by the withdrawal of the wire from the cavity by the precision feed motor 212. In general, the lateral width and the vertical height of the cavity 170 is adjusted to accommodate different diameters and column deflection strength characteristics of wire 52. Such adjustment may be achieved by positioning the location of the contact bars 178 and 180 at a greater or lesser lateral separation, or by changing the lateral width of the contact bars 178 and 180.

Figure 13:
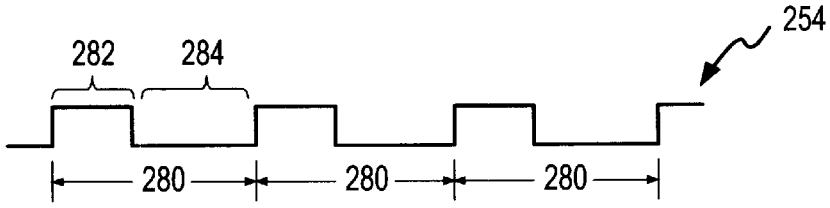
FIG. 13 is a waveform diagram of a power control signal created by the control system shown in FIG. 11.

The relatively high rotational rate of the pre-feed motor 150, and the rotation of the gear reduction head 151, will continue rotating the pre-feed capstan 152 after the termination of the power control signal 254, due to the rotational inertia or "wind-down" effect of these elements. To counter the effects of wind-down, and to obtain more precise control from a conventional relatively-inexpensive, direct-current, high-rotational speed motor 150 driving a conventional planetary gear reduction head 151, the power control signal 254 is delivered from the motor controller 252 (FIG. 11) in the form of a duty cycle signal as shown in FIG. 13. Separate cycles of the duty cycle control signal 254 are designated at 280. During each cycle 280, there is an on-time portion 282 of the signal 254 during which power is delivered to the pre-feed motor 150 and there is an off-time portion 284 of the signal 254 during which power is not delivered to the pre-feed motor 150.

The frequency of occurrence of the duty cycles 280 is sufficiently rapid to cause a generally continuous operation of the pre-feed motor 150, but not so frequent as to allow the rotational inertia effects of wind-down to advance more wire into the cavity than is desired. The frequency of the occurrence of the cycles 280, and the amount of on-time 282 relative to the off-time 284 during each cycle 280, is adjusted in accordance with the rotational inertia effects of wind-down from the motor 150 and the gear head 151. Of course, when the power control signal 254 is negated, no duty cycles 280 occur at all. The power control signal 254 controls the transistor switch 256 (FIG. 11) which delivers DC current to the pre-feed motor 150 during the on-times 282 of each cycle 280.

The precision feed motor 212 is preferably a conventional stepper motor. As such, the times of its rotation and the extent of its rotation are precisely controlled by pulse signals which cause the stepper motor 212 to rotate in a predetermined increment of a full rotation for each pulse delivered. For example, one pulse might cause the stepper motor 212 to rotate one rotational increment or one degree. A predetermined number of rotational increments are required to cause the motor 212 to rotate one complete revolution. Moreover, the stepper motor 212 responds by advancing through the rotational increment very rapidly in response to the delivery of each pulse. Consequently, there is very little time latency between the delivery of each pulse to the stepper motor 212 and the increment of rotation achieved by that pulse.

The ratio of the pulleys 206 and 210, and the diameter of the spindle 200 (FIG. 10), are all taken into account to determine the fractional amount of one revolution of the spindle 200 caused by one pulse applied to the stepper motor 212. The fractional amount of one revolution of the spindle 200 is directly related to the amount of linear advancement of the wire 52 by the spindle 200. By recognizing these relationships, the amount of wire 52 advanced by the spindle 200 is precisely controlled by delivering a predetermined number of pulses to the stepper motor 212 which will result in the advancement of the wire 52 by a linear amount which correlates to the predetermined number of pulses delivered to the stepper motor 212.

For example, if the relationship is such that one pulse to the stepper motor will result in the advancement of the wire by 0.001 inch, the advancement of the wire by ¼ of an inch (0.250 inch) is achieved by applying 250 pulses to the stepper motor. The position of the wire is also achieved in a similar manner. As another example in which one pulse to the stepper motor will result in the advancement of the wire by 0.001 inch, if it is desired to space the bulges 58 apart from one another along the twist pin 50 by an interval 76 (FIG. 1) of 1/10 of an inch (0.100 inch) and the length consumed by each bulge 58 is 2/10 of an inch (0.200 inch), the wire 52 is advanced by 3/10 of an inch to form the sequential bulges by applying 300 pulses to the stepper motor 212.

Because of the relatively rapid response and acceleration characteristics of the stepper motor 212, the stepper motor 212 is capable of advancing the wire 52 very rapidly. Thus, the stepper motor 212 offers the advantages of precise amounts of advancement of the wire 52, precise positioning of the wire 52 during the formation of the bulges 58, and positioning and advancement of the wire on a very rapid basis.

In forming the twist pin 50, the number of pulses delivered to the stepper motor 212 is calculated to correlate to the desired position, the desired amount of advancement and hence the length of the wire 52 into the bulge forming mechanism 106 to create the desired length of the leader 68, to create the desired amount of interval 76 between the bulges 58, and to create the desired length of the tail 72 at the location where the wire 52 is severed after the formation of the twist pin 50. As is discussed below in conjunction with the bulge forming mechanism 106, the delivery of the calculated number of pulses is also timed to coincide with operational states of the bulge forming mechanism 106, thus assuring that the wire is advanced to the calculated extent at the appropriate time to coincide with the proper operational state of the bulge forming mechanism 106.

The wire feeding mechanism 104 of the present invention cooperatively interacts with the bulge forming mechanism 106 in the regard that the position where the bulges in the twist pin are formed is established by the advancement of the wire by the wire feeding mechanism 104. Specific details concerning the bulge forming mechanism 106 are described in the above-referenced and concurrently-filed U.S. patent application, Ser. No. 09/782,888. However, some of the general details of the bulge forming mechanism 106 are described here as context for the present invention.

The bulge forming mechanism 106 (FIGS. 6 and 7) comprises a stationary gripping assembly, a rotating gripping assembly, and a drive motor which rotates the gripping assemblies relative to one another in complete relative revolutions. The wire 52 is advanced from the feed wire mechanism 104 through a stationary clamp member 298 (FIG. 7) of the stationary gripping assembly and through a rotating clamp member of the rotating clamp assembly which is positioned directly below the stationary clamp member 298 (FIG. 7). The stationary clamp member and the rotating clamp member open approximately simultaneously to allow the wire 52 to be advanced. Both the stationary and the rotating clamp members thereafter close approximately simultaneously to grip the wire 52.

The stationary clamp member closes around the wire 52 with sufficient force to restrain the wire 52 against rotation. The rotating clamp member also closes around the wire 52 with sufficient force to hold the wire 52 stationary with respect to the rotating clamp member. However, because the rotating clamp member is rotating, the grip of the wire 52 by the rotating clamp member rotates the wire 52 in the opposite or anti-helical direction compared to the direction that the strands 54 have been initially wound around the core strand 56 (FIG. 1). As a result of the reverse or anti-helical rotation imparted by the rotating gripping assembly one bulge 58 is formed between the rotating clamp member and the stationary clamp member.

After formation of the bulge 58, both the stationary and the rotating clamp members are again opened, and the wire feed mechanism 104 advances the wire 52 to position the wire at a predetermined position along the length of the wire 52 where the next bulge 58 (FIG. 1) will be formed. After all the bulges have been formed along a segment of the wire which constitutes the twist pin 50, it is necessary to sever the twist pin configuration from the remaining continuous wire in order to complete the fabrication of the twist pin. Under such conditions, the wire is advanced until the end 70 of the leader 68 or the end 74 of the tail 72 (FIG. 1) is in a position below the bulge forming mechanism 106 (FIGS. 6 and 7). The wire 52 is advanced by the wire feed mechanism 104 through the bulge forming mechanism 106 until a point on the wire is aligned with the point where a laser beam will be trained onto the wire. The laser beam device 110 is then activated, and the energy from the laser beam severs the wire by melting it into two pieces, thus forming an end 74 of the in tail 72 on one severed piece and the end 70 of the leader 68 on the other severed piece (FIG. 1). Melting at the ends 70 and 74 fuses the strands 54 and 56 together to simultaneously form the ends 70 and 74. The severed twist pin whose fabrication has just been completed is removed by the inductor mechanism 108 and conveyed to a receptacle 118 of the cassette 116. More details concerning the inductor mechanism 108 and the twist pin receiving mechanism 114 are described in the above-referenced and concurrently-filed U.S. patent application Ser. No. 09/780,981.

In summary of the improvements described above, the wire feed mechanism 104 unwinds wire from the spool 102 and advances it into the cavity 170 to form the S-shaped configuration 234. The S-shaped configuration 234 constitutes sufficient slack wire to decouple the rotational inertia of the spool 102 from the advancement of the wire into the bulge forming mechanism 106. Consequently, by maintaining the S-shaped configuration of slack wire and then advancing slack wire from the S-shaped configuration 234 into the bulge forming mechanism 106, the wire is more precisely advanced into a desired position in the bulge forming mechanism 106 because it need not be unwound against the resistance and inertia of the wire from the spool 102. The slack wire of the S-shaped configuration 234 does not create sufficient inertia or mass that will result in slippage of the wire as it is advanced by the precision feed motor 212.

The wire is unwound from the spool into the wire feed mechanism 104 directly by the rotational effects of the pre-feed motor 150, and the wire is advanced from the cavity 170 by the direct rotation of the precision feed motor 212. Both motors 150 and 212 are directly controlled to rotate on an as-needed basis to advance the wire. No reciprocating movements are involved in advancing the wire into the cavity 170 or from the cavity 170 into the bulge forming mechanism 106. Therefore, greater efficiency is achieved by the continual and direct wire-advancing action, without lost movement and without the latency involved in the non-productive return strokes of reciprocating wire advancement mechanisms. By avoiding the problems associated with accelerating and decelerating the reciprocating mechanisms or the spool during unwinding of the wire, and by not having to account for the latency and potential slippage induced by such mechanisms, the wire feed mechanism 104 of the present invention offers the ability to feed the wire more rapidly and precisely to achieve a higher production rate of twist pins.

A presently preferred embodiment of the invention and many of its improvements have been described with a degree of particularity. This description is of a preferred example of implementing the invention and is not necessarily intended to limit the scope of the invention. The scope of the invention is defined by the following claims.

What is claimed is:

1. A wire feed mechanism for receiving wire from a wire source and advancing the wire, comprising:

a cavity within which to receive wire from the source;

a wire-supplying device in contact with the wire from the source and operative to supply wire from the source into the cavity as slack wire;

the slack wire within the cavity curving into two bends defining an S-shaped configuration that does not permanently deform the slack wire within the cavity;

a wire-advancing device in contact with the slack wire from the cavity and operative to withdraw slack wire from the cavity and to advance the wire withdrawn from the cavity;

a sensor located in the cavity to sense the curvature of at least one of the bends of the slack wire in the S-shaped configuration within the cavity, the sensor supplying a signal indicative of the curvature sensed; and a controller responsive to the signal from the sensor and connected to the wire-supplying device to control the wire-supplying device to supply wire from the source into the cavity in response to the signal from the sensor to maintain the slack wire in the cavity in the S-shaped configuration as the wire-advancing device withdraws slack wire from the cavity.

2. A wire feed mechanism as defined in claim 1 further comprising:

a second sensor in addition to the sensor first aforesaid; and wherein:

the first sensor senses the curvature of a first one of the two bends of the slack wire within the cavity defining the S-shaped configuration, the first sensor supplying a first signal related to the curvature of the first bend;

the second sensor senses the curvature of a second one of the two bends of the slack wire within the cavity defining S-shaped configuration, the second sensor supplying a second signal related to the curvature of the second bend; and the controller is responsive to the first and second signals to control the wire-supplying device to supply the wire from the source into the cavity to maintain the two bends of the slack wire in the S-shaped configuration in the cavity.

3. A wire feed mechanism as defined in claim 2 wherein:

the first and second signals relate to the extent of curvature of the two bends of the S-shaped configuration in the cavity; and the controller controls the wire-supplying device to supply the wire into the cavity until first and second sensors have sensed that the bends of the slack wire in the S-shaped configuration have each achieved a predetermined extent of curvature within the cavity.

4. A wire feed mechanism as defined in claim 2 wherein:

each sensor includes a contact which touches one bend of the slack wire in the S-shaped configuration within the cavity to indicate a predetermined extent of curvature of the bend;

the first and second sensors supply the first and second signals upon the two bends of the slack wire in the S-shaped configuration touching the contacts of the first and second sensors, respectively; and the controller activates the wire-supplying device to continue to supply wire until the first and second sensors supply the first and second signals, respectively.

5. A wire feed mechanism as defined in claim 1 wherein:

the sensor includes a contact within the cavity which is touched by one bend of the slack wire within the cavity in the S-shaped configuration upon the one bend attaining a predetermined curvature characteristic;

the slack wire in the cavity is electrically connected to an electrical source;

the signal is supplied by the sensor when the one bend of the slack wire touches the contact of the sensor; and the signal is created by electrical conductivity between the contact and the one bend of the slack wire which touches the contact.

6. A wire feed mechanism as defined in claim 1 wherein:

the wire-supplying device and the wire-advancing device are positioned vertically relative to one another to supply the wire into the cavity and withdraw the wire from the cavity at substantially vertically oriented locations relative to one another; and the two bends of the S-shaped configuration of the slack wire within the cavity are located on respectively opposite and lateral sides of a vertical line extending between the vertically oriented locations at which the wire-supplying device and the wire-advancing device supply the wire into the cavity and withdraw the wire from the cavity, respectively.

7. A wire feed mechanism as defined in claim 6 wherein:

the wire-supplying device is oriented to supply the wire substantially vertically into the cavity; and the wire-advancing device is oriented to withdraw the slack wire substantially vertically from the cavity.

8. A wire feed mechanism as defined in claim 1 wherein:

the wire-supplying device supplies wire to the cavity independently of the wire-advancing device withdrawing wire from the cavity.

9. A wire feed mechanism as defined in claim 8 wherein:

the wire-advancing device is positioned exteriorly from the cavity in contact with the slack wire from the cavity and is operative to withdraw a predetermined amount of slack wire from the cavity and advance the predetermined amount of withdrawn wire at one time.

10. A wire feed mechanism for receiving wire from a wire source and advancing the wire, comprising:

a cavity within which to receive wire from the source;

a wire-supplying device in contact with the wire from the source and operative to supply wire from the source into the cavity as slack wire;

the slack wire curving in the cavity into two bends that do not permanently deform the slack wire within the cavity;

a wire-advancing device in contact with the slack wire from the cavity and operative to withdraw slack wire from the cavity and to advance the wire withdrawn from the cavity;

a first sensor located in the cavity to sense a predetermined characteristic of a first one of the two bends of the slack wire within the cavity and to supply a first signal indicative of the occurrence of the predetermined characteristic of the first bend;

a second sensor located in the cavity to sense a predetermined characteristic of a second one of the two bends of the slack wire within the cavity and to supply a second signal indicative of the occurrence of the predetermined characteristic of the second bend; and a controller responsive to the first and second signals and connected to the wire-supplying device to control the wire-supplying device to supply wire from the source into the cavity in response to the first and second signals to maintain the slack wire in the cavity bent into the two bends as the wire-advancing device withdraws slack wire from the cavity.

11. A wire feed mechanism as defined in claim 10 wherein:

the two bends of the slack wire in the cavity define an S-shaped configuration of the slack wire within the cavity; and the predetermined characteristics sensed by the first and second sensors is the extent of curvature of the first and second bends within the cavity, respectively.

12. A wire feed mechanism as defined in claim 11 wherein:

the first sensor includes a first contact within the cavity;

the second sensor includes a second contact within the cavity;

the first sensor supplies the first signal in response to the first bend of the S-shaped configuration of the slack wire interacting with the contact of the first sensor; and the second sensor supplies the second signal in response to the second curve of the S-shaped configuration of the slack wire interacting with the contact of the second sensor.

13. A wire feed mechanism as defined in claim 12 wherein:

the first and second contacts are respectively positioned at laterally opposite positions within the cavity;

the first bend of slack wire of the S-shaped configuration curves within the cavity laterally toward the first contact; and the second bend of the slack wire of the S-shaped configuration curves within the cavity laterally toward the second contact.

14. A wire feed mechanism as defined in claim 13 wherein:

the controller controls the wire-supplying device to supply wire to the cavity upon the assertion of only one of the first and second signals; and the controller controls the wire-supplying device to terminate the supply of wire to the cavity upon the concurrent assertion of both the first and second signals.

15. A wire feed mechanism as defined in claim 10 wherein the wire source is a spool upon which the wire has been wound and from which the wire is unwound by the wire-supplying device, and wherein the wire-supplying device comprises:

a roller which frictionally contacts the wire at a location between the spool and the cavity; and a roller drive motor connected to rotate the roller.

16. A wire feed mechanism as defined in claim 15 wherein:

the controller supplies a power control signal for energizing the roller drive motor, the power control signal having a repeating duty cycle characteristic, the duty cycle characteristic having an on-time during which power is supplied to the roller drive motor and an off-time during which power is not supplied to the roller drive motor.

17. A wire feed mechanism as defined in claim 16 wherein:

the wire-supplying device further comprises a gear head connected between the roller drive motor and the roller, the roller drive motor rotating the gear head, and the gear head rotating the roller.

18. A wire feed mechanism as defined in claim 10 wherein:

the roller drive motor is a direct current (DC) motor.

19. A wire feed mechanism as defined in claim 10 wherein the wire-advancing device comprises:

a spindle positioned in frictional contact with the wire and operative when rotated to withdraw slack wire from the cavity; and a spindle drive motor connected to the spindle to rotate the spindle while in contact with the wire to advance the wire as a result of the rotation of the spindle.

20. A wire feed mechanism as defined in claim 19 wherein:

the spindle drive motor is a stepper motor.

21. A wire feed mechanism as defined in claim 10 wherein:

each sensor includes a contact which is touched by one bend of the slack wire within the cavity in the S-shaped configuration upon the one bend achieving the predetermined characteristic;

the slack wire in the cavity is electrically connected to an electrical source;

the first signal is supplied by the first sensor when a first one of the two bends of the slack wire in the cavity touches the contact of the first sensor;

the second signal is supplied by the second sensor when a second one of the two bends of the slack wire in the cavity touches the contact of the second sensor; and the first and second signals are created by electrical conductivity between the contact and the bend of the slack wire which touches the contact.

22. A wire feed mechanism as defined in claim 10 wherein:

the wire-supplying device and the wire-advancing device are positioned substantially vertically relative to one another to supply the wire into the cavity and withdraw the wire from the cavity at substantially vertically oriented locations relative to one another; and the first and second bends of the slack wire within the cavity are located on respectively opposite and lateral sides of a vertical line extending between the vertically oriented locations at which the wire-supplying device and the wire-advancing device supply the wire into the cavity and withdraw the wire from the cavity, respectively.

23. A wire feed mechanism as defined in claim 22 wherein:

the wire-supplying device is oriented to supply the wire substantially vertically into the cavity; and the wire-advancing device is oriented to withdraw the slack wire substantially vertically from the cavity.

24. A wire feed mechanism as defined in claim 22 wherein:

the two bends of the slack wire in the cavity define an S-shaped configuration of the slack wire within the cavity.

25. A wire feed mechanism as defined in claim 10 wherein:

the wire-supplying device supplies wire to the cavity independently of the wire-advancing device withdrawing wire from the cavity.

26. A wire feed mechanism as defined in claim 25 wherein:

the wire-advancing device is positioned exteriorly from the cavity in contact with the slack wire from the cavity and is operative to withdraw a predetermined amount of slack wire from the cavity and advance the predetermined amount of withdrawn wire at one time.

27. A wire feed mechanism for receiving wire from a source and advancing the wire, comprising:

a cavity within which to receive wire from the source;

a wire-supplying device in contact with the wire from the source and operative to supply wire from the source into the cavity as slack wire;

the slack wire within the cavity bending into a curved configuration having oppositely curved bends that do not permanently deform the slack wire within the cavity;

a wire-advancing device in contact with the slack wire from the cavity and operative to withdraw slack wire from the cavity and to advance the wire withdrawn from the cavity;

an electrical source connected to the slack wire;

a contact within the cavity at a position to be touched by one of the bends of the curved configuration of the slack wire within the cavity upon the slack wire attaining a predetermined degree of curvature within the cavity;

the contact and the slack wire creating a signal by electrical conductivity between the wire and the contact when the one bend of the slack wire touches the contact; and a controller connected to the wire-supplying device and operative to control the wire-supplying device to supply wire from the source to maintain the slack wire in the cavity in the curved configuration in response to the signal as the wire-advancing device withdraws slack wire from the cavity.

28. A wire feed mechanism for receiving wire from a source and advancing the wire, comprising:

a cavity within which to receive wire from the source;

a wire-supplying device in contact with the wire from the source and operative to supply wire from the source into the cavity as slack wire;

the slack wire within the cavity bending into a curved configuration having two bends that do not permanently deform the slack wire within the cavity;

a wire-advancing device in contact with the slack wire from the cavity and operative to withdraw slack wire from the cavity and to advance the wire withdrawn from the cavity;

an electrical source connected to the slack wire;

a contact within the cavity at a position to be touched by the bend of the curved configuration of the slack wire within the cavity upon the slack wire attaining a predetermined degree of curvature within the cavity;

a signal created by electrical conductivity when the bend of the slack wire touches the contact; and a controller connected to the wire-supplying device and operative to control the wire-supplying device to supply wire from the source to maintain the slack wire in the cavity in the curved configuration in response to the signal as the wire-advancing device withdraws slack wire from the cavity; and wherein:

the wire-supplying device and the wire-advancing device are positioned vertically relative to one another to supply the wire into the cavity and withdraw the wire from the cavity at substantially vertically oriented locations relative to one another; and the two bends of the curved configuration of the slack wire within the cavity are located on respectively opposite and lateral sides of a vertical line extending between the vertically oriented locations at which the wire-supplying device and the wire-advancing device supply the wire into the cavity and withdraw the wire from the cavity, respectively.

29. A wire feed mechanism as defined in claim 28 wherein:

the wire-supplying device is oriented to supply the wire substantially vertically into the cavity; and the wire-advancing device is oriented to withdraw the slack wire substantially vertically from the cavity.

30. A wire feed mechanism as defined in claim 27 wherein:

the wire-supplying device supplies wire to the cavity independently of the wire-advancing device withdrawing wire from the cavity.

31. A wire feed mechanism as defined in claim 30 wherein:

the wire-advancing device is positioned exteriorly from the cavity in contact with the slack wire from the cavity and is operative to withdraw a predetermined amount of slack wire from the cavity and advance the predetermined amount of withdrawn wire at one time.

32. A wire feed mechanism for receiving wire from a source and advancing the wire, comprising:

a cavity within which to receive wire from the source;

a wire-supplying device in contact with the wire from the source and operative to supply wire from the source into the cavity as slack wire;

the slack wire within the cavity bending into a curved configuration having first and second bends that do not permanently deform the slack wire within the cavity;

a wire-advancing device in contact with the slack wire from the cavity and operative to withdraw slack wire from the cavity and to advance the wire withdrawn from the cavity;

an electrical source connected to the slack wire;

a first contact within the cavity at a position to be touched by the first bend of the curved configuration of the slack wire within the cavity upon the slack wire attaining a predetermined degree of curvature within the cavity;

the first contact at a position to be touched by the first bend of the curved configuration of the slack wire within the cavity upon the first bend attaining a predetermined degree of curvature within the cavity;

the first contact and the slack wire creating a first signal, by electrical conductivity when the first bend of the slack wire touches the first contact;

a second contact within the cavity at a position to be touched by the second bend of the curved configuration of the slack wire within the cavity upon the second bend attaining a predetermined degree of curvature within the cavity; and the second contact and the slack wire creating a second signal by electrical conductivity when the second bend of the slack wire touches the second first contact; and a controller connected to the wire-supplying device and operative to control the wire-supplying device to supply wire from the source to maintain the slack wire in the cavity in the curved configuration in response to the first and second signals as the wire-advancing device withdraws slack wire from the cavity.

33. A wire feed mechanism as defined in claim 32 wherein:

the first and second bends of the curved configuration of the slack wire in the cavity define an S-shaped configuration of the slack wire within the cavity.

34. A wire feed mechanism as defined in claim 32 wherein:

the wire-supplying device and the wire-advancing device are positioned vertically relative to one another to supply the wire into the cavity and withdraw the wire from the cavity at substantially vertically oriented locations relative to one another; and the first and second bends of the curved configuration of the slack wire within the cavity are located on respectively opposite and lateral sides of a vertical line extending between the vertically oriented locations at which the wire-supplying device and the wire-advancing device supply the wire into the cavity and withdraw the wire from the cavity, respectively.

35. A wire feed mechanism as defined in claim 34 wherein:

the wire-supplying device is oriented to supply the wire substantially vertically into the cavity; and the wire-advancing device is oriented to withdraw the slack wire substantially vertically from the cavity.

36. A wire feed mechanism for receiving wire from a source and advancing the wire, comprising:

a cavity within which to receive wire from the source;

a wire-supplying device in contact with the wire from the source and operative to supply wire from the source into the cavity as slack wire;

the slack wire within the cavity bending into an S-shaped configuration that does not permanently deform the slack wire within the cavity;

a wire-advancing device in contact with the slack wire from the cavity and operative to withdraw slack wire from the cavity and to advance the wire withdrawn from the cavity;

a sensor located within the cavity to sense a predetermined characteristic of the slack wire indicative of the S-shaped configuration within the cavity; and a controller connected to the sensor and to the wire-supplying device to control the wire-supplying device to supply wire from the source to maintain the slack wire in the cavity in the S-shaped configuration indicated by the sensor as the wire-advancing device withdraws slack wire from the cavity.

37. A wire feed mechanism as defined in claim 36 wherein:

the wire-advancing device is positioned exteriorly from the cavity in contact with the slack wire from the cavity and is operative to withdraw a predetermined amount of slack wire from the cavity and advance that predetermined amount of wire.

38. A wire feed mechanism as defined in claim 36 wherein:

the wire-supplying device supplies wire to the cavity independently of the wire-advancing device withdrawing wire from the cavity.

39. A wire feed mechanism as defined in claim 36 wherein the wire is formed from helically coiled strands, the wire is advanced to be used as an electrical connector, the electrical connector is a twist pin having a length with a predetermined position where strands of the wire have been uncoiled in an anti-helical direction to form a bulge, and wherein:

the wire-advancing device advances the wire into a bulge forming mechanism; and the wire-advancing device advances the wire to a predetermined position where a bulge is formed in the wire by the bulge forming mechanism.

40. A wire feed mechanism as defined in claim 36 wherein:

the predetermined characteristic of the slack wire sensed by the sensor is a degree of curvature of a bend of the S-shaped configuration within the cavity.

41. A method of withdrawing wire from a wire source and advancing the withdrawn wire, comprising the steps of:

withdrawing wire from the wire source and applying the withdrawn wire as slack wire;

bending the slack wire into a curved configuration having at least two oppositely curved bends;

electrically connecting the slack wire to an electrical source;

sensing a predetermined characteristic of at least one bend of slack wire in the curved configuration by touching the one bend to a contact upon the one bend achieving the predetermined characteristic;

advancing slack wire from the curved configuration;

sensing a change in the predetermined characteristic by sensing electrical conductivity between the one bend and the contact; and maintaining the curved configuration of the slack wire by supplying additional slack wire to the curved configuration to compensate for the slack wire advanced from the curved configuration in response to the change in the sensed characteristic of the one bend.

42. A method as defined in claim 41 further comprising the step of:

supplying the additional wire independently of advancing the slack wire.

43. A method as defined in claim 41 further comprising the step of:

limiting the curvature of the one bend of the curved configuration to a curvature that does not result in a permanent deforming in the wire.

44. A method withdrawing wire formed from helically coiled strands, from a wire source and advancing the withdrawn wire for use as a twist pin electrical connector, having a length with a predetermined position where strands of the wire have been uncoiled in an anti-helical direction to form a bulge, comprising the steps of:

withdrawing wire from the wire source and applying the withdrawn wire as a slack wire;

bending the slack wire into a curved configuration having at least one bend;

electrically connecting the slack wire to an electrical source;

sensing a predetermined characteristic of at least one bend of slack wire in the curved configuration by touching the one bend to a contact upon the one bend achieving the predetermined charcteristic;

advancing the slack wire from the curved configuration to establish the predetermined position at which to form a bulge;

sensing a change in the predetermined characteristic by sensing electrical conductivity between the one bend and the contact;

maintaining the curved configuration of the slack wire by supplying additional slack wire to the curved configuration to compensate for the slack wire advanced from the curved configuration in response to the change in the sensed characteristic of the one bend; and forming the bulge at the predetermined position after the slack wire has been advanced to the predetermined position.

45. A method of withdrawing wire from a wire source and advancing the withdrawn wire, comprising the steps of:

withdrawing wire from the wire source and applying the withdrawn wire as slack wire;

bending the slack wire into first and second bends which define a curved configuration;

electrically connecting the slack wire to an electrical source;

sensing a predetermined characteristic of the first and second bends of slack wire in the curved configuration by touching the first bend to a first contact upon the first bend achieving the predetermined characteristic;

and by touching the second bend to a second contact upon the second bend achieving the predetermined characteristic;

determining touching of the first bend to the first contact by sensing a change in electrical conductivity between the first bend and the first contact;

determining touching of the second bend to the second contact by sensing a change in electrical conductivity between the second bend and the second contact; and advancing slack wire from the curved configuration;

sensing a change in the predetermined characteristic by sensing electrical conductivity between at least one of the first bend and the first contact and the second band and the second contact; and maintaining the curved configuration of the slack wire by supplying additional slack wire to the curved configuration to compensate for the slack wire advanced from the curved configuration in response to changes in the predetermined characteristics sensed in both the first and second bends.

46. A method as defined in claim 45 further comprising the step of:

bending the slack wire into an S-shaped configuration defined by the two bends.

47. A method as defined in claim 45 further comprising the steps of:

supplying slack wire to the cavity when neither the first bend nor the second bend touch the first or second contacts, respectively, and when only one of the first or second bends touches one of the first or second contacts, respectively; and terminating supplying slack wire to the curved configuration when both the first and second bend touch the first and second contacts, respectively.

48. A method of withdrawing wire from a wire source and advancing the withdrawn wire, comprising the steps of:

withdrawing wire from the wire source and applying the withdrawn wire as a slack wire;

bending the slack wire into a curved configuration having first and second bends;

electrically connecting the slack wire to an electrical source;

sensing a predetermined characteristic of at least one bend of slack wire in the curved configuration by touching the one bend to a contact upon the one bend achieving the predetermined characteristic;

advancing slack wire from the curved configuration;

sensing a change in the predetermined characteristic by sensing electrical conductivity between the one bend and the contact;

maintaining the curved configuration of the slack wire by supplying additional slack wire to the curved configuration to compensate for the slack wire advanced from the curved configuration in response to the change in the sensed characteristic of the one bend;

supplying the slack wire to the curved configuration and advancing the slack wire from the curved configuration at locations which are substantially vertically oriented relative to one another; and locating the first and second bends of the slack wire at respectively opposite and lateral sides of a vertical line extending between the vertical positions at which the slack wire is supplied to and advanced from the curved configuration.

49. A method as defined in claim 48 further comprising the steps of:

supplying the slack wire substantially vertically to the curved configuration; and advancing the slack wire substantially vertically from the curved configuration.

50. A method of withdrawing wire from a wire source and advancing the withdrawn wire, comprising the steps of:

withdrawing wire from the wire source and supplying the withdrawn wire as slack wire;

bending the slack wire into an S-shaped configuration having two bends;

sensing a predetermined characteristic of at least one of the bends of slack wire in the S-shaped configuration;

advancing slack wire from the S-shaped configuration;

supplying slack wire to the S-shaped configuration from the wire source to compensate for the slack wire advanced from the S-shaped configuration; and maintaining the S-shaped configuration of the slack wire in response to a change in the sensed predetermined characteristic of the one bend.

51. A method as defined in claim 50 further comprising the steps of:

sensing the predetermined characteristic with respect to both bends of the S-shaped configuration; and maintaining the S-shaped configuration of the slack wire in response to changes in the sensed predetermined characteristics of both bends.

52. A method as defined in claim 51 further comprising the steps of:

sensing the predetermined characteristic of a first one of the two bends of slack wire in the S-shaped configuration by touching the first bend to a first contact upon the first bend achieving the predetermined characteristic;

sensing the predetermined characteristic of a second one of the two bends of the slack wire in the S-shaped configuration by touching the second bend to a second contact upon the second bend achieving the predetermined characteristic; and determining the changes in the sensed predetermined characteristics of the first and second bends by the touching of the first and second bends with the first and second contacts, respectively.

53. A method as defined in claim 52 further comprising the steps of:

electrically connecting the slack wire to an electrical source;

determining whether the first bend touches the first contact by sensing electrical conductivity between the first bend and the first contact; and determining whether the second bend touches the second contact by sensing electrical conductivity between the second bend and the second contact.

54. A method as defined in claim 53 further comprising the steps of:

supplying slack wire to the cavity when neither the first nor the second bends touching the first or second contacts, respectively, and when only one of the first or second bends touches one of the first or second contacts, respectively; and terminating supplying of slack wire to the S-shaped configuration upon both the first and second bends touching the first and second contacts, respectively.

55. A method as defined in claim 50 further comprising the step of:

sensing the extent of curvature of the one bend of the S-shaped configuration as the predetermined characteristic.

56. A method as defined in claim 50 further comprising the step of:

sensing the position of the one bend of the S-shaped configuration as the predetermined characteristic.

57. A method as defined in claim 50 further comprising the steps of:

touching the one bend of the slack wire in the S-shaped configuration to a contact upon the one bend achieving the predetermined characteristic; and determining the change in the sensed predetermined characteristic of the one bend by the touch of the one bend to the contact.

58. A method as defined in claim 57 further comprising the steps of:

electrically connecting the slack wire to an electrical source; and determining whether the one bend touches the contact by sensing electrical conductivity between the one bend and the contact.

59. A method as defined in claim 50 further comprising the steps of:

supplying the slack wire to the S-shaped configuration and advancing the slack wire from the S-shaped configuration at positions which are substantially vertically oriented relative to one another; and locating the first and second bends of the slack wire at respectively opposite and lateral sides of a vertical line extending between the vertically oriented positions at which the slack wire is supplied to and advanced from the S-shaped configuration.

60. A method as defined in claim 59 further comprising the steps of:

supplying the slack wire substantially vertically to the S-shaped configuration; and advancing the slack wire substantially vertically from the S-shaped configuration.

61. A method as defined in claim 50 further comprising the step of:

supplying the additional slack wire independently of advancing the slack wire.

62. A method as defined in claim 50 further comprising the steps of:

limiting the curvature of each bend to avoid permanently deforming the wire.

63. A method of withdrawing wire from a wire source and advancing the withdrawn wire, comprising the steps of:

withdrawing wire from the wire source and supplying the withdrawn wire as slack wire;

bending the slack wire in a curved configuration having a first bend and a second bend;

sensing a predetermined characteristic of the curved configuration;

advancing slack wire from the curved configuration;

supplying the slack wire to the curved configuration and advancing the slack wire from the curved configuration at positions which are located substantially vertical relative to one another;

locating the first and second bends at respectively opposite and lateral sides of a vertical line extending between the vertical positions at which the slack wire is supplied to and advanced from the curved configuration;

sensing a change in the predetermined characteristic of the curved configuration; and maintaining the curved configuration of the slack wire by supplying additional slack wire to the curved configuration to compensate for the slack wire advanced from the curved configuration in response to the change in the sensed characteristic of the curved configuration.

64. A method as defined in claim 63 further comprising the steps of:

supplying the slack wire substantially vertically to the curved configuration; and advancing the slack wire substantially vertically from the curved configuration.

65. A method as defined in claim 63 further comprising the steps of:

electrically connecting the slack wire to an electrical source;

sensing a predetermined characteristic of both the first and second bends of the curved configuration;

sensing a change in the predetermined characteristics of the first bend of slack wire in the curved configuration by touching the first bend to a first contact upon the first bend achieving the predetermined characteristic;

sensing a change in the predetermined characteristics of the second bend of slack wire in the curved configuration by touching the second bend to a second contact upon the second bend achieving the predetermined characteristic;

determining touching of each of the first bend to the first contact by sensing a change in electrical conductivity between the first bend and the first contact;

determining touching of each of the second bend to the second contact by sensing a change in electrical conductivity between the second bend and the second contact; and maintaining the curved configuration of the slack wire by supplying additional slack wire to the curved configuration to compensate for the slack wire advanced from the curved configuration in response to changes in the sensed predetermined characteristics of both the first and second bends.

66. A method as defined in claim 65 further comprising the steps of:

supplying slack wire to the cavity when neither the first nor the second bends touch the first or second contacts, respectively, and when only one of the first or second bends touches one of the first or second contacts, respectively; and terminating supplying slack wire to the curved configuration upon both the first and second bends touching the first and second contacts, respectively.

67. A method as defined in claim 63 further comprising the step of:

supplying the additional slack wire independently of advancing the slack wire.

68. A method as defined in claim 63 further comprising the step of:

limiting the curvature of each bend to avoid permanently deforming the wire.

* * * * *